US010916206B2

(12) United States Patent
Jung et al.

(10) Patent No.: US 10,916,206 B2
(45) Date of Patent: Feb. 9, 2021

(54) DISPLAY APPARATUS AND CONTROL METHOD THEREOF

(71) Applicant: SAMSUNG ELECTRONICS CO., LTD., Suwon-si (KR)

(72) Inventors: Yoosun Jung, Suwon-si (KR); Shinhaeng Kim, Suwon-si (KR); Wonseok Song, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/233,966

(22) Filed: Dec. 27, 2018

(65) Prior Publication Data

US 2019/0206337 A1 Jul. 4, 2019

(30) Foreign Application Priority Data

Jan. 2, 2018 (KR) ..... 10-2018-0000322

(51) Int. Cl.
*G09G 3/34* (2006.01)
*G09G 3/36* (2006.01)

(52) U.S. Cl.
CPC ..... *G09G 3/3406* (2013.01); *G09G 3/36* (2013.01); *G09G 2320/0247* (2013.01); *G09G 2320/0257* (2013.01); *G09G 2320/0261* (2013.01); *G09G 2320/0606* (2013.01); *G09G 2320/0646* (2013.01); *G09G 2320/103* (2013.01); *G09G 2320/106* (2013.01); *G09G 2354/00* (2013.01)

(58) Field of Classification Search
CPC . G09G 3/3406; G09G 3/36; G09G 2310/0237
See application file for complete search history.

(56) References Cited

U.S. PATENT DOCUMENTS 6,563,495 B1 * 5/2003 Griepentrog ..... G09G 1/06 345/10
9,019,194 B2 4/2015 Seo
2003/0142118 A1 * 7/2003 Funamoto ..... G09G 3/3406 345/691

(Continued)

FOREIGN PATENT DOCUMENTS

KR 10-2008-0064931 A 7/2008
KR 10-2016-0036385 A 4/2016

OTHER PUBLICATIONS

International Search Report (PCT/ISA/210) and Written Opinion (PCT/ISA/237) dated Apr. 26, 2019 issued by the International Searching Authority in International Application No. PCT/KR2018/016657.

(Continued)

*Primary Examiner* — Kevin M Nguyen
(74) *Attorney, Agent, or Firm* — Sughrue Mion, PLLC

(57) ABSTRACT

A display apparatus and control method thereof are provided. The display apparatus includes: a display panel; a driver configured to drive the display panel based on an image signal; a light source configured to supply light for making an image visible on the display panel; and a processor configured to: control the light source to have two or more emissive sections during a displaying period for one video frame of the image signal, and control a first emissive section and a second emissive section, of the two or more emissive sections, to have different widths in accordance with a change in the image.

20 Claims, 17 Drawing Sheets

(56) References Cited

U.S. PATENT DOCUMENTS

| | | | | |
|---|---|---|---|---|
| 2005/0259064 | A1 | 11/2005 | Sugino et al. | |
| 2006/0107214 | A1 | 5/2006 | Kim | |
| 2007/0273678 | A1* | 11/2007 | Okita | G09G 3/342 345/204 |
| 2008/0165117 | A1 | 7/2008 | Jung et al. | |
| 2009/0147154 | A1* | 6/2009 | Arai | G09G 3/346 348/750 |
| 2009/0303331 | A1* | 12/2009 | Yoon | G09G 3/006 348/189 |
| 2010/0020002 | A1 | 1/2010 | Van Woudenberg et al. | |
| 2010/0315408 | A1 | 12/2010 | Kang et al. | |
| 2012/0147291 | A1 | 6/2012 | Seo | |
| 2013/0141473 | A1 | 6/2013 | Moon et al. | |
| 2017/0076674 | A1 | 3/2017 | Shintani | |
| 2017/0124962 | A1* | 5/2017 | Oh | G09G 3/3648 |

OTHER PUBLICATIONS

Communication dated Sep. 18, 2020, issued by the European Patent Office in European Application No. 18898280.5.

* cited by examiner

DISPLAY APPARATUS AND CONTROL METHOD THEREOF

CROSS-REFERENCE TO RELATED APPLICATION

This application is based on and claims priority under 35 U.S.C. § 119 to Korean Patent Application No. 10-2018-0000322, filed on Jan. 2, 2018 in the Korean Intellectual Property Office, the disclosure of which is incorporated by reference herein in its entirety.

BACKGROUND

1. Field

The disclosure relates to a display apparatus using a backlight unit to emit light so that a non-emissive display panel can display an image, and a control method thereof, and more particularly to a display apparatus in which light-emitting operations of a backlight unit are controlled corresponding to a displayed video frame in consideration of visibility of a user who views an image displayed in units of the video frame, and a control method thereof.

2. Description of Related Art

A display apparatus refers to an apparatus that includes a display panel to display an image with light, based on a broadcast or image signal of various formats. A television (TV) is a representative example of the display apparatus. There are various types of display panels depending on hardware structures for displaying an image and the sizes of effective screen where an image is displayed. Further, such display panels are applied to various kinds of display apparatuses according to their intended uses.

There are many ways of classifying the display panels. For example, the display panels are classified as a self-emissive panel structure and a non-emissive panel structure according to light emission types. The display panel having the non-emissive panel structure cannot emit light by itself, and therefore additionally needs a light source or a backlight unit for emitting light to the display panel. In this regard, the non-emissive panel structure may be also called a light receiving panel structure, and a liquid crystal display (LCD) panel is a representative example of the light receiving panel structure. On the other hand, the self-emissive panel structure does not separately need the backlight unit since it can emit light by itself. For example, an organic light emitting diode (OLED) panel is a representative example of the self-emissive panel structure.

In accordance with the structures of the display panel applied to the display apparatus, some phenomena may be observed in terms of visibility of a user who views an image. Such phenomena may, for example, include: a motion blur phenomenon that causes a user to recognize that a predetermined object has an unclear and blurry outline as if the movement of the object is dragged in an image; a flicker phenomenon that causes a user to recognize that an image flicker has occurred in a low frequency fluorescent lamp; and an afterimage or double-image phenomenon that causes a user to recognize an object as overlapped objects. The motion blur phenomenon and the afterimage phenomenon may be similar in that the outline of the object is not clearly recognized.

Such phenomena may or may not be recognized according to a user's subjective feeling. However, the reason why the phenomena occur is because the display panel and/or the display apparatus has structural or operational problems. For example, in a case of the display apparatus including the LCD panel, the motion blur phenomenon, the flicker phenomenon, the afterimage phenomenon, etc., are mainly caused by display apparatus operations of driving the liquid crystal of the display panel or driving the backlight unit in response to an image signal.

SUMMARY

Provided are a method, apparatus, and non-transitory computer readable medium for controlling emissive states of a light source for a display panel.

Additional aspects will be set forth in part in the description which follows and, in part, will be apparent from the description, or may be learned by practice of the presented embodiments.

In accordance with an aspect of the disclosure, a display apparatus includes: a display panel; a driver configured to drive the display panel based on an image signal; a light source configured to supply light for making an image visible on the display panel; and a processor configured to: control the light source to have two or more emissive sections during a displaying period for one video frame of the image signal, and control a first emissive section and a second emissive section, of the two or more emissive sections, to have different widths in accordance with a change in the image.

In accordance with another aspect of the disclosure, a method of controlling a display apparatus includes: driving a display panel based on an image signal; controlling a light source, which is provided to supply light to the display panel, to have two or more emissive sections during a displaying period for one video frame of the image signal; and controlling a first emissive section and a second emissive section, of the two or more emissive sections, to have different widths in accordance with a change in an image.

In accordance with another aspect of the disclosure, a nonvolatile computer-readable recording medium stores a program code of a method implementable by a processor of a display apparatus, the method including: driving a display panel based on an image signal; controlling a light source, which is provided to supply light to the display panel, to have two or more emissive sections during a displaying period for one video frame of the image signal; and controlling a first emissive section and a second emissive section, of the two or more emissive sections, to have different widths in accordance with a change in an image.

In accordance with another aspect of the disclosure, a processing apparatus includes: a memory configured to store instructions; and at least one processor configured to execute the stored instructions to: control a light source for a display panel to have two or more emissive sections during a displaying period for one video frame of an image signal, and control a first emissive section and a second emissive section, of the two or more emissive sections, to have different widths in accordance with a change in the image.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Below, embodiments will be described in detail with reference to accompanying drawings. Further, the embodiments described with reference to the accompanying drawings are not exclusive to each other unless otherwise mentioned, and a plurality of embodiments may be selectively combined within one apparatus. The combination of these embodiments may be discretionally selected and applied to realize the present inventive concept(s) by a person having an ordinary skill in the art.

As used herein, the terms "1st" or "first" and "2nd" or "second" may use corresponding components regardless of importance or order and are used to distinguish one component from another without limiting the components.

Further, it is understood that expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

Figure 1:
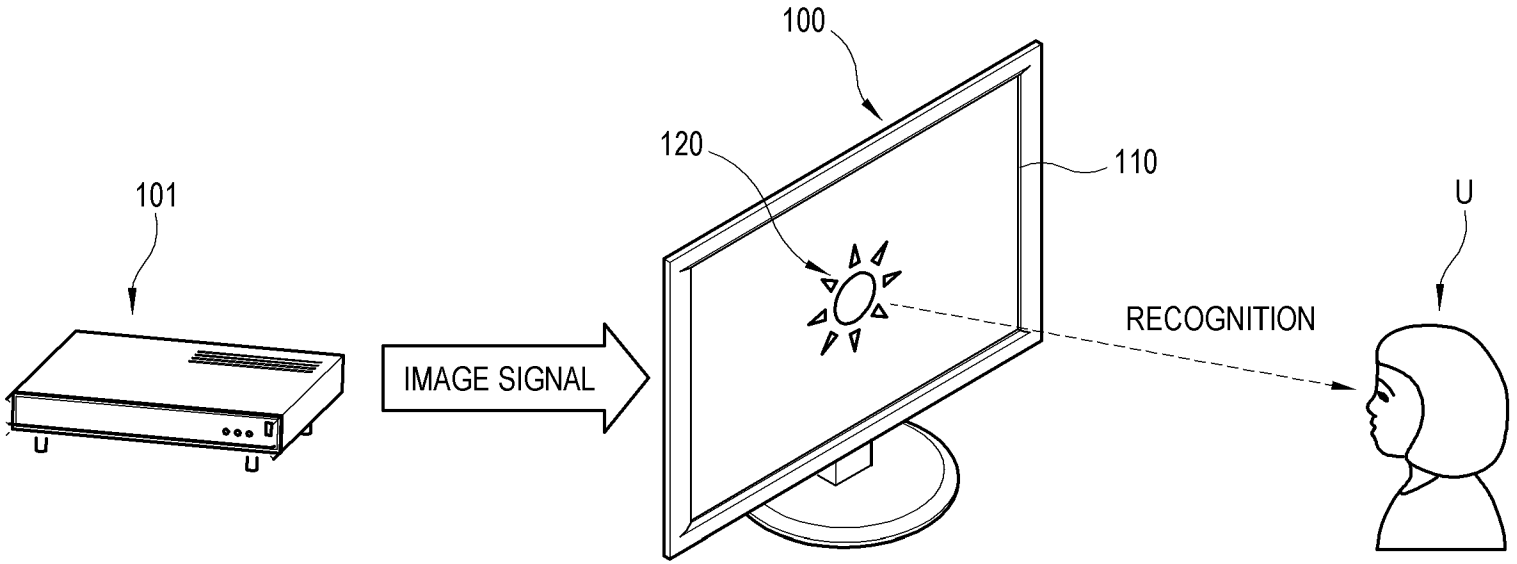
FIG. 1 illustrates an example of a display apparatus according to an embodiment displaying an image.

FIG. 1 illustrates an example of a display apparatus 100 according to an embodiment displaying an image;

As shown in FIG. 1, the display apparatus 100 according to the present embodiment processes an image signal by an image processing process, and displays an image 120 on a screen of a display panel 110. The display apparatus 100 may receive an image signal from a source device 101, or may acquire an image signal from data stored in a built-in memory of the display apparatus 100. While in the present embodiment, the display apparatus 100 is a TV, it is understood that one or more other embodiments are not limited thereto, and the display apparatus 100 may be any apparatus capable of displaying an image, such as a monitor, a computer, a tablet, a digital signage, an electronic frame, a video wall, a portable multimedia player, a mobile phone, a wearable device, etc.

The display apparatus 100 may receive an image signal from various types of source devices 101. When the source device 101 is a transmitter of a broadcasting station, an image signal is transmitted as a terrestrial broadcast signal to the display apparatus 100 by a broadcast method. When the source device 101 is a network server, an image signal is transmitted as a data packet to the display apparatus 100 by a broadband method. When the source device 101 is a set-top box or an optical medium player, an image signal is transmitted to the display apparatus 100 in accordance with high definition multimedia interface (HDMI) or the like local area signal transmission standards.

The display apparatus 100 according to the present embodiment includes a display panel 110 having a liquid crystal structure, though it is understood that one or more other embodiments are not limited thereto. To display the image 120, the display apparatus 100 having such a structure performs two operations: one is for controlling an orientation of liquid crystal corresponding to the image by driving the liquid crystal in units of pixel in response to an image signal, and the other one is for emitting light to the display panel 110 of which liquid crystal has the controlled orientation.

Since the display panel 110 having the liquid crystal structure cannot emit light by itself, a backlight unit is placed behind the display panel 110. The light emitted from the backlight unit enters the back of the display panel 110, passes through the liquid crystal, and exits the front of the display panel 110, so that a user U in front of the display apparatus 100 can recognize the image 120 on the display panel 110.

However, in a related art, a motion blur phenomenon, a flicker phenomenon, an afterimage phenomenon, etc., may occur in the image 120 displayed on the display panel 110 having the liquid crystal structure. Thus, the goal of providing a clear and vivid image to a user U may be encumbered by such phenomena. These phenomena may occur even when the image 120 does not have a substantial motion, but may occur more prominently when the image 120 has a considerably large motion.

Thus, the display apparatus 100 according to an embodiment controls the operation of the backlight unit as follows. The display apparatus 100 controls the backlight unit to have at least two emissive sections within a displaying period of a certain video frame among a plurality of video frames of an image signal, and controls a first emissive section of the at least two emissive sections to have a smaller width than a second emissive section. Thus, the display apparatus 100 according to the present embodiment suppresses the motion blur phenomenon, the flicker phenomenon, and the afterimage phenomenon, thereby improving display quality of the image 120. Details of the reason why each phenomenon is suppressed will be described below.

Below, the elements of a display apparatus according to an embodiment will be described.

Figure 2:
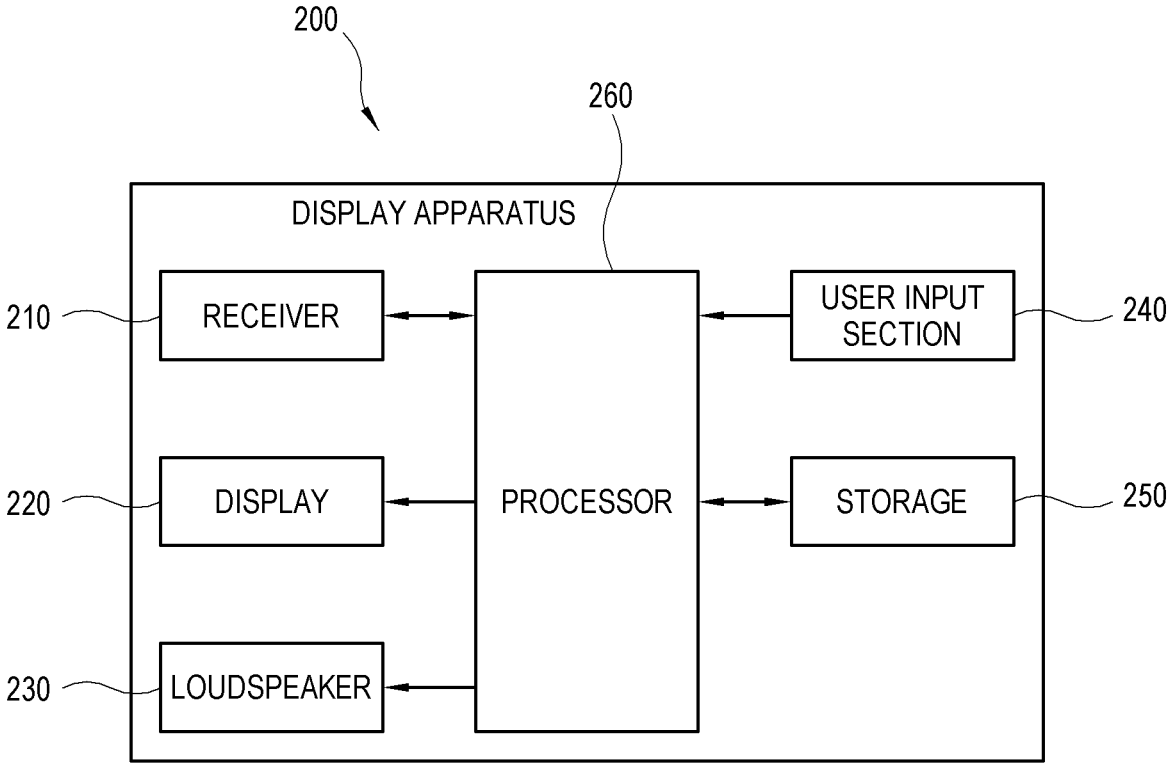
FIG. 2 is a block diagram of a display apparatus according to an embodiment.

FIG. 2 is a block diagram of a display apparatus 200 according to an embodiment.

As shown in FIG. 2, a display apparatus 200 includes a receiver 210 for receiving an image signal from the outside (i.e., from an external source), a display 220 for displaying an image based on the image signal received in the receiver 210, a loudspeaker 230 for outputting a sound, a user input section 240 for executing an operation based on a user's input, a storage 250 for storing data, and a processor 260 for processing an image signal to be displayed as an image.

The receiver 210 includes a communication circuit for receiving an image signal from various source devices. The receiver 210 may perform bidirectional communication for not only receiving a signal from the outside, but also transmitting a signal from the display apparatus 200 to the outside. The receiver 210 may be materialized by combination of a communication port, a communication module, and a communication chip corresponding to various communication standards, and its supportable protocol is not limited to only one protocol. The receiver 210 may include a radio frequency (RF) module, interface, or transceiver for receiving an RF signal, a wireless communication module, interface, or transceiver for wireless network communication, an Ethernet module, interface, or transceiver for wired network communication, a connection port for connection with an external memory or the like, and so on. Further, when the display apparatus 200 is a TV, the receiver 210 may include a tuner for selectively receiving a broadcast signal.

The display 220 displays an image based on a video signal processed by the processor 260. According to the present embodiment, the display 220 includes an LCD panel, a backlight unit, etc., as described above.

The loudspeaker 230 outputs a sound based on an audio signal processed by the processor 260. The loudspeaker 230 may include a unit loudspeaker provided corresponding to an audio channel of an audio signal. In accordance with the number of audio channels, there may be a plurality of unit loudspeakers.

The user input section 240 generates a preset command or information in response to a user's control or input, and transmits the preset command or information to the processor 260. The user input section 240 may be embodied in various forms according to a user's input environment, for example, at least one of a button provided an outer side of the display apparatus 200, a remote controller provided remotely from a main body of the display apparatus 200, a touch screen installed on the display 220, etc.

The storage 250 is configured to store data under process and control of the processor 260. The data stored in the storage 250 is subjected to reading, recording, modifying, deleting, updating, etc., by the processor 260. The storage 250 may be broadly classified into two types, i.e., volatile and nonvolatile types, and the display apparatus 200 may have both types of the storage 250. The storage 250 may include a flash memory, a hard disk drive (HDD), a solid-state drive (SSD), a read only memory (ROM) etc., as a nonvolatile memory in which data is retained even though power is off. Further, the storage 250 may include a random-access memory (RAM), a buffer, etc., as a volatile memory in which data is retained only while power is on.

The processor 260 processes a signal in accordance with the characteristics of the signal received in the receiver 210. In a case of an image signal, the processor 260 may, for example, perform demultiplexing, decoding, scaling, noise reduction, detail enhancement, and the like image processing processes. The processor 260 may include a central processing unit (CPU), a microprocessor, a chipset, a system on chip (SoC), and the like operation circuit. According to the present embodiment, the processor 260 may include a panel driver for driving a display panel, and a backlight unit controller for driving a backlight unit.

Below, a method of controlling a display apparatus according to an embodiment will be described.

Figure 3:
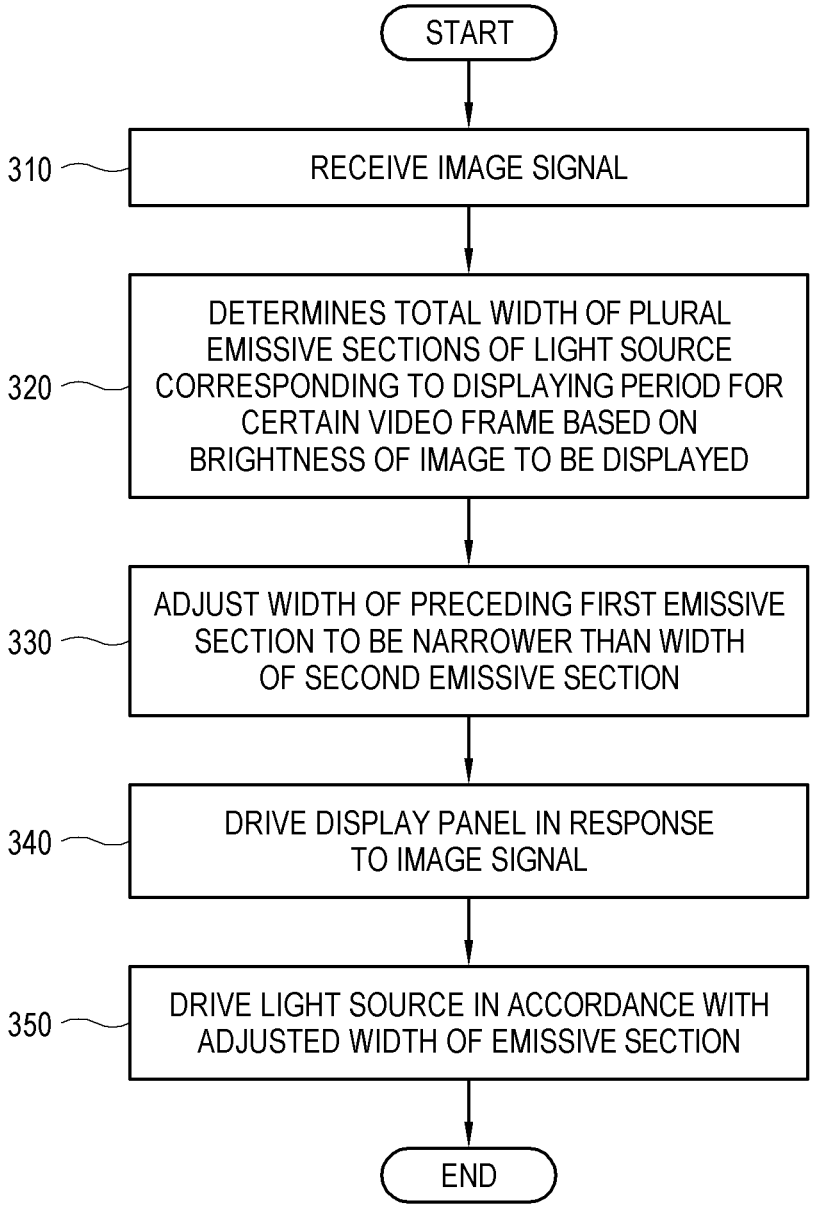
FIG. 3 is a flowchart showing a method of controlling a display apparatus according to an embodiment.

FIG. 3 is a flowchart showing a method of controlling a display apparatus according to an embodiment.

The operations for controlling the display apparatus as described with reference to FIG. 3 may be carried out by the processor of the display apparatus.

Referring to FIG. 3, the display apparatus receives an image signal at operation 310.

At operation 320, the display apparatus determines a total width of a plurality of emissive sections of a light source corresponding to a displaying period of a certain video frame on the basis of the brightness of an image to be displayed. That is, the emissive section is a time section during which the light source generates and emits light. Therefore, a total width (or length) of an emissive section corresponding to a displaying period of a certain video frame is proportional to the brightness of when the video frame is displayed as an image. As the total width increases, the brightness of the image becomes higher. As the total width decreases, the brightness of the image becomes lower. Here, the width may be given in units of time, or may be given in units of data bit calculated per unit time. In the present embodiment, two emissive sections will be described by way of example, though it is understood that one or more other embodiments are not limited thereto. Alternatively, there may be a plurality of emissive sections, i.e., two or more emissive sections corresponding to a displaying period of a certain video frame.

At operation 330, the display apparatus adjusts the width of the first emissive section to be narrower than the width of the second emissive section among the plurality of emissive sections, i.e., the width of the second emissive section to be larger than the width of the first emissive section. Here, the first emissive section precedes the second emissive section.

At operation 340, the display apparatus drives the display panel in response to an image signal. Specifically, the display apparatus adjusts an orientation of liquid crystal at each pixel of the display panel in response to an image signal.

At operation 350, the display apparatus displays an image by driving the light source in accordance with the adjusted width of the emissive section. The light from the light source is incident to the display panel in which the orientation of the liquid crystal has been adjusted, thereby making the image visible on the display panel.

Below, the structures and functions of the display panel for carrying out the foregoing operations will be described.

Figure 4:
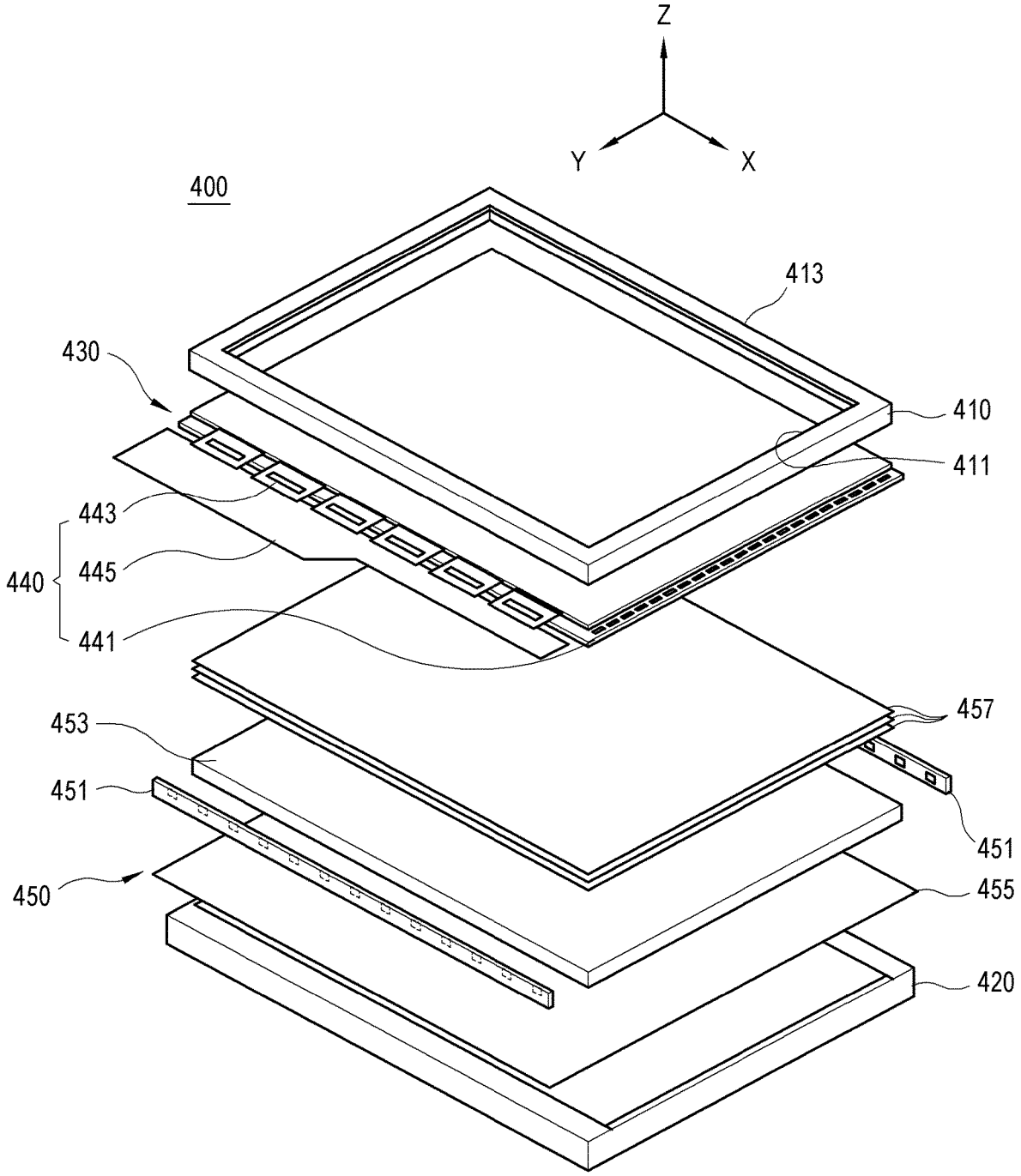
FIG. 4 is an exploded perspective view of a display apparatus according to an embodiment.

FIG. 4 is an exploded perspective view of a display apparatus 400 according to an embodiment.

As shown in FIG. 4, a display apparatus 400 includes cover frames 410 and 420, a display panel 430 accommodated in an accommodating space between the cover frames 410 and 420 and displaying an image, a panel driver 440 for driving the display panel 430, and a backlight unit 450 placed behind the display panel 430 within the accommodating space formed by the cover frames 410 and 420 and emitting light to the display panel 430.

In FIG. 4, X, Y and Z directions indicate the horizontal, vertical and normal directions of the display panel 430, respectively. The display panel 430 is arranged in parallel with an X-Y plane formed by an X-axial line and a Y-axial line, and the cover frames 410 and 420, the display panel 430 and the backlight unit 450 are arranged to be stacked along a Z-axial line. The opposite directions to the X, Y and Z directions are represented by −X, −Y and −Z directions, respectively. Further, unless otherwise specified, an "upside," "upward," or "front" direction corresponds to the Z direction in FIG. 4, and a "downside," "downward," "back," or "behind" corresponds to the −Z direction. For example, the backlight unit 450 is placed at a downside of or behind the display panel 430, and light emitted from the backlight unit 450 enters a downside or back surface of the display panel 430 and exits an upside or front surface of the display panel 430.

The cover frames 410 and 420 support the display panel 430 and the backlight unit 450 accommodated therebetween, while forming a rectangular outer appearance of the display apparatus 400. Referring to FIG. 4, assuming that the Z direction is an upper or front direction of the display panel 430 and the −Z direction be a lower or back direction of the display panel 430, the cover frames 410 and 420 include a front cover 410 for supporting the front of the display panel 430, and a back cover 420 for supporting the back of the backlight unit 450. The front cover 410 includes an opening 411 on a plane parallel with the X-Y plane so that a surface of the display panel 430, on which an image is displayed, can be exposed to the outside through the opening 411. Further, a bezel 413 is formed around the opening 411.

The display panel 430 is a non-emissive device that does not emit light by itself. According to the present embodiment, the display panel 430 has a liquid crystal structure. In the display panel 430 having the liquid crystal structure, a liquid crystal layer is sandwiched between two transparent substrates, and orientation of liquid crystals is adjusted in units of pixel in response to a driving signal, thereby displaying an image on the panel thereof. The display panel 430 receives light from the backlight unit 450 since it cannot emit light by itself. This light is incident to the bottom surface of the display panel 430, passes through the liquid crystal layer, and exits from the top surface of the display panel 430.

The panel driver 440 applies a driving signal for driving the liquid crystal layer to the display panel 430. The panel driver 440 includes a gate driver 441, a data driver 443, and a timing controller 445.

The gate driver 441 includes an integrated circuit mounted to the substrate of the display panel 430 and connected to the gate lines of the display panel 430.

The data driver 443 includes a data chip film package connected to the data lines of the display panel 430. The data driver 443 may include a tape-automated bonding (TAB) tape in which a semiconductor chip is bonded to a wiring pattern formed on a base film by TAB technology. Further, the data driver 443 may, for example, use a tape carrier package (TCP), a chip on film (COF), etc.

The timing controller 445 inputs a gate driving signal to the gate driver 441, and a data driving signal to the data driver 443.

With this configuration, the panel driver 440 inputs the driving signals to the gate lines and data lines of the display panel 430, and drives the liquid crystal layer of the display panel 430 in units of pixel.

The backlight unit 450 is arranged in the −Z direction of the display panel 430 to emit light to the bottom surface of the display panel 430. The backlight unit 450 includes a light source 451, a light guide plate 453 arranged in parallel with the display panel 430 and facing the bottom surface of the display panel 430, a reflection plate 455 arranged between the light guide plate 453 and a rear cover 420 and returning light toward the bottom surface of the light guide plate 453, and one or more optical sheets 457 interposed between the display panel 430 and the light guide plate 453.

The light source 451 generates light to be supplied toward the display panel 430 by converting received voltage into the light. In the present embodiment, the light source 451 is arranged at the edge of the light guide plate 453, thereby having a structure in which a light-emitting direction of the light source 451 is perpendicular to a light-exiting direction of the light guide plate 453. The backlight unit 450 having such a structure is called an edge-type backlight unit. When the light-emitting direction of the light source 451 is parallel to the light-exiting direction of the light guide plate 453, the backlight unit 450 having this structure will be called a direct-type structure. That is, in a case where light exits the light guide plate 453 in the Z direction, a structure in which the light source 451 emits light in the Y or −Y direction is called the edge-type structure, and a structure in which the light source 451 emits light in the Z direction is called the direct-type structure. The present inventive concept is applicable regardless of whether the backlight unit 450 has the edge-type structure or the direct-type structure.

The light source 451 includes a plurality of light emitting devices mounted on a substrate extended along a certain direction and arranged in a row. On the substrate, a wiring line to which voltage is applied is printed to thereby supply the voltage to the light emitting devices (LEDs). The light emitting devices may be variously configured to emit light based on voltage. By way of example, a light emitting diode is used as an LED.

The light guide plate 453 refers to a plastic lens molded by injecting an acrylic material or the like, and uniformly guides incident light from the light source 451 to the entire surface of the display panel 430, on which an image is displayed. The bottom surface of the light guide plate 453 faces the reflection plate 455, and the lateral surface between the top surface and the bottom surface of the light guide plate 453 faces the light source 451. When the backlight unit 450 has the edge-type structure, the light emitted from the light source 451 enters the lateral surface of the light guide plate 453.

The bottom surface of the light guide plate 453 is formed with an optical pattern for causing light propagating in the light guide plate 453 to be diffusely reflected or change in a traveling direction. Since the optical pattern causes the light be diffusely reflected and travel in the Z direction, the light from the light source 451 exits the top surface of the light guide plate 453 and is distributed as uniformly as possible.

The reflection plate 455 is provided under the light guide plate 453, and reflects the light exiting the bottom surface of the light guide plate 453 toward the light guide plate 453. Specifically, the reflection plate 455 causes the light, which is not reflected from the optical pattern of the light guide plate 453 in the Z direction but exits in the −Z direction, to be reflected in the Z direction, and thus be incident to the light guide plate 453 again. To this end, the top surface of the reflection plate 455 has a characteristic of total reflection.

One or more optical sheets 457 are provided as stacked above the top surface of the light guide plate 453, thereby controlling the optical characteristics of the light exiting from the top surface of the light guide plate 453 toward the display panel 430. The one or more optical sheets 457 may include a diffusion sheet, a prism sheet, a dual brightness enhancement film (DBEF), a protection sheet, etc., one or more of which may be applied by considering the ultimate results of the optical characteristics to be controlled.

Below, a structure for displaying an image on the display panel 430 by operations of the panel driver 440 and the backlight unit 450 will be described.

Figure 5:
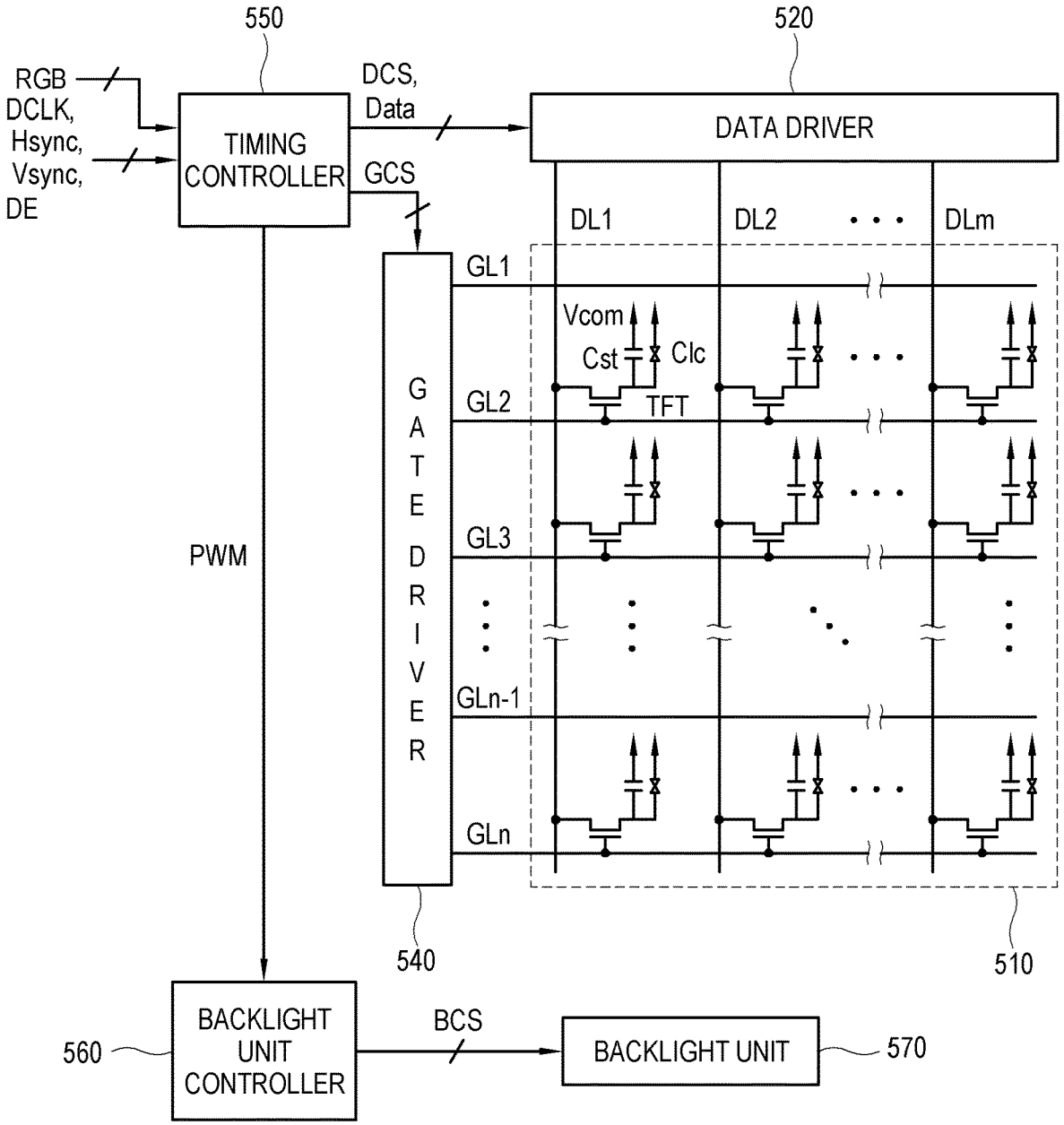
FIG. 5 is a block diagram showing a structure for driving a display panel in a display apparatus according to an embodiment.

FIG. 5 is a block diagram showing a structure for driving a display panel 510 in a display apparatus according to an embodiment.

In the display panel 510 as shown in FIG. 5, a plurality of gate lines GL1 to GLn and a plurality of data lines DL1 to DLm are configured to intersect, thereby defining pixel areas. A gate driver 540 is connected to each of the plurality of gate lines GL1 to GLn, and a data driver 520 is connected to each of the plurality of data lines DL1 to DLm.

A timing controller 550 divides the display panel 510 into a plurality of blocks and controls the gate driver 540 and data driver 520 so that odd-numbered blocks can be sequentially used to display an image signal in an odd-numbered video frame, and even-numbered blocks can be sequentially used to display the image signal in an even-numbered video frame.

A backlight unit controller 560 uses a non-sequential scanning method to drive a backlight unit 570 in accordance with a pulse width modulation (PWM) signal provided by the timing controller 550. The backlight unit controller 560 transmits a backlight control signal (BCS) to the backlight unit 570, so that the backlight unit 570 can emit light to each block of the display panel 510.

Each pixel area defined by the plurality of gate lines GL1 to GLn and the plurality of data lines DL1 to DLm includes a thin film transistor (TFT), a liquid crystal capacitor (Clc) connected to the TFT, and a storage capasitor (Cst). The liquid crystal capacitor Clc includes a pixel electrode connected to the TFT, and a common electrode applying an electric field to the liquid crystal together with the pixel electrode. The TFT transmits an image signal from the data lines DL1 to DLm to the pixel electrode in response to scan pulses of the gate lines GL1 to GLn. The liquid crystal capacitor Clc is charged with a voltage corresponding to a difference between an image signal applied to the pixel electrode and a common voltage Vcom applied to the common electrode, and adjusts light transmittance by changing an array of liquid crystal molecules in accordance with voltage differences, thereby accomplishing gradation. The storage capacitor Cst connects in parallel with the liquid crystal capacitor Clc and keeps the voltage charged in the liquid crystal capacitor Clc until the next image signal is applied.

The gate driver 540 sequentially supplies scan pulses to the plurality of gate lines GL1 to GLn in response to a gate signal GCS provided by the timing controller 550.

The data driver 520 converts an image signal, that is received from the timing controller 550 in response to the data control signal DCS provided by the timing controller 550, into a signal based on a reference gamma voltage, and supplies the converted image signal to the data lines DL1 to DLm.

The method, by which the display apparatus with this structure controls the operations of the backlight unit, will be described in detail below.

Figure 6:
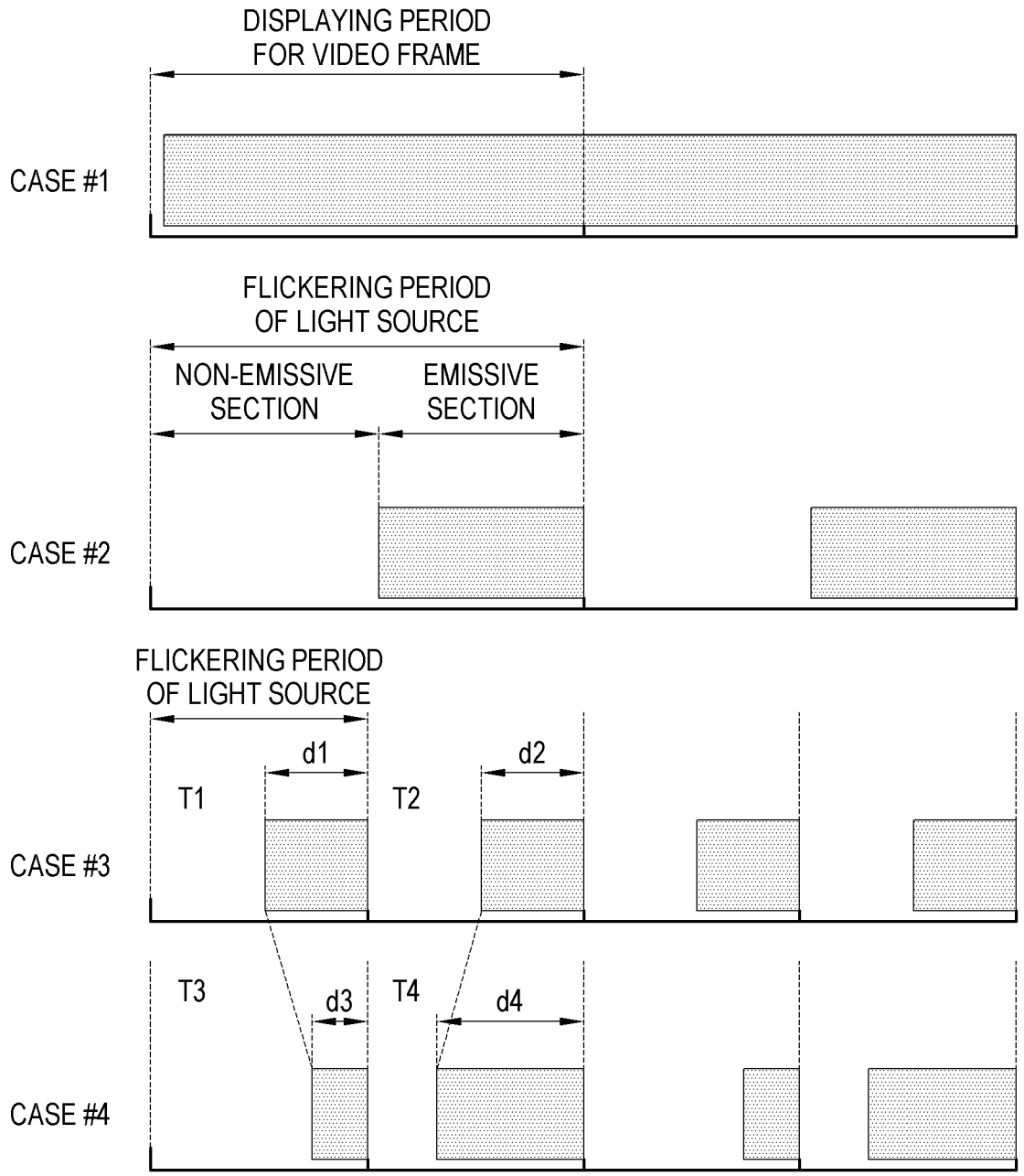
FIG. 6 is a duty-ratio graph for comparison between a case where a display apparatus according to an embodiment controls a flicker of a backlight unit and other cases.

FIG. 6 is a duty-ratio graph for comparison between a case where a display apparatus according to an embodiment controls a flicker of a backlight unit and other cases.

FIG. 6 illustrates four cases where the display apparatus controls flicker operations of the light source. Among the four cases, the case #4 shows an embodiment of the present disclosure, and the cases #1, #2 and #3 are provided for comparison with the case #4. In these duty ratio graphs, the axis of abscissa indicates time, and the axis of ordinate indicates voltage or current applied to a light source.

The display apparatus determines a displaying period for each video frame when receiving an image signal including a plurality of video frames arranged in time sequence. For example, when the displaying period for the video frame is determined as (1/60)sec, i.e., when a displaying frequency is 60 Hz, the liquid crystal of the display panel is driven in accordance with the determined displaying period.

At a point in time when a displaying period for a certain video frame begins, a driving signal corresponding to the video frame is applied to the liquid crystal of the display panel. The liquid crystal moves toward a designated position or orientation in response to the driving signal, and is then stabilized at the designated position or orientation in a latter part of the displaying period. When this displaying period is terminated and a displaying period for the next video frame begins, a driving signal corresponding to the next video frame is applied to the liquid crystal so that the liquid crystal is changed in position or orientation.

Further, the display apparatus determines the flickering period of the light source on the basis of the displaying period of the video frame, and controls the light source to flicker in response to the determined flickering period. Thus, the display apparatus displays an image on the display panel.

The case #1 shows that the light source is continuously turned on without flickering. In this case, the light source continuously emits light even while display of a certain video frame is switched over to display of the next video frame. Therefore, a user may see an image corresponding to a transitional period between a certain video frame and its subsequent video frame before the liquid crystal is stabilized. Because afterimages of a certain object in the image are continuously accumulated while a user views such a transitional image, a motion blur phenomenon occurs as if the movement of the object is dragged in the image.

The case #2 shows that the displaying period for the video frame is equal to the flickering period of the light source. For example, the display apparatus adjusts the flickering period of the light source to be 60 Hz like the displaying period of 60 Hz for the video frame.

By controlling the light source to flicker like the case #2, i.e., by controlling the light source to alternately have an emissive section and a non-emissive section so as to keep a non-emissive state until the liquid crystal is stabilized and become an emissive state after the liquid crystal is stabilized, it is possible to restrain the motion blur phenomenon that occurs in the case #1.

However, when the displaying period for the video frame is equal to the flickering period of the light source like the case #2, a flicker phenomenon occurs. Within a certain flickering period of the light source, the non-emissive section precedes the emissive section. In the case #2, the non-emissive section has a long width. That is, the section where light is not emitted from the light source is so long that a user can feel as if the image flickers.

The case #3 shows that the flickering period of the light source is shorter than the displaying period for the video frame, specifically, a plurality of flickering periods is set corresponding to a displaying period for one video frame. For example, when the displaying period for the video frame is 60 Hz, the light source may be set to have a flickering period of 120 Hz. In this case, two flickering periods correspond to the displaying period for one video frame. Of course, this is merely one example, and three or more flickering periods may be designed to correspond to the displaying period for one video frame.

When voltage of one level is applied to the light source in the cases #2 and #3, and 'd1+d2' in the case #3 is equal to the width of the emissive section in the case #2, the emissive section in the case #2 corresponding to a displaying period for a certain video frame has the same total area as the emissive section in the case #3. That is, the video frame displayed in the case #2 has the same brightness as the video frame displayed in the case #3.

In the case #3, a first flickering period T1 and a second flickering period T2 are set corresponding to the displaying period for one video frame. The first flickering period T1 precedes the second flickering period T2. The width d1 of the emissive section in the first flickering period T1 is equal to the width d2 of the emissive section in the second flickering period T2. With this manner, the case #3 restrains or reduces the flicker phenomenon that occurs in the case #2.

However, the case #3 may cause a new afterimage or double-image. Since the first flickering period T1 precedes the second flickering period T2, the first flickering period T1 corresponds to a transitional period of liquid crystal in the display panel, during which the liquid crystal moves toward a designated position or orientation, and the second flickering period T2 corresponds to a stable period of the liquid crystal during which the liquid crystal is arrayed in the designated position or orientation. That is, the array of the liquid crystal is unstable during the first flickering period T1, and is not generally aligned with the array of the liquid crystal during the second flickering period T2. Therefore, a user feels as if an image displayed with light emitted from the light source during the first flickering period T1 overlaps with an image displayed with light emitted from the light source during the second flickering period T2, and thus views a double image of an object within the image.

The operations of the light source in the case #2 are enough to eliminate only the afterimage phenomenon. However, as described above, the flicker phenomenon occurs in the case #2. Accordingly, the case #4 is proposed to restrain or minimize the phenomena in the cases #1, #2, and #3.

The case #4 is similar to the case #3 in that a plurality of flickering periods is set corresponding to the displaying period for one video frame. In the case #4, a first flickering period T3 and a second flickering period T4 are set corresponding to the displaying period for one video frame. The first flickering period T3 precedes the second flickering period T4. Unlike the case #3, the case #4 shows that a width d3 of an emissive section in the first flickering period T3 is different from a width d4 of an emissive section in the second flickering period T4.

Here, a total duty section of the case #3 is equal to a total duty section of the case #4. That is, the sum of the emissive sections in the case #3 corresponding to the displaying period for the video frame is equal to the sum of the emissive section in the case #4. This means that the brightness for the video frame in the case #3 is equal to the brightness for the video frame in the case #4.

In the case #4, the width d3 of the emissive section in the first flickering period T3 is narrower than the width d4 of the emissive section in the second flickering period T4. As compared with the case #3 where the widths d1 and d2 are equal, the case #4 shows that the width d3 of the emissive section in the first flickering period T3 is relatively decreased, and the width d4 of the emissive section in the second flickering period T4 is relatively increased.

Thus, the display apparatus in the case #4 restrains the motion blur phenomenon, the flicker phenomenon, and the afterimage phenomenon even while keeping the original brightness, and provides an image of improved quality to a user. Below, details of restraining the foregoing phenomena in the case #4 will be described.

Figure 7:
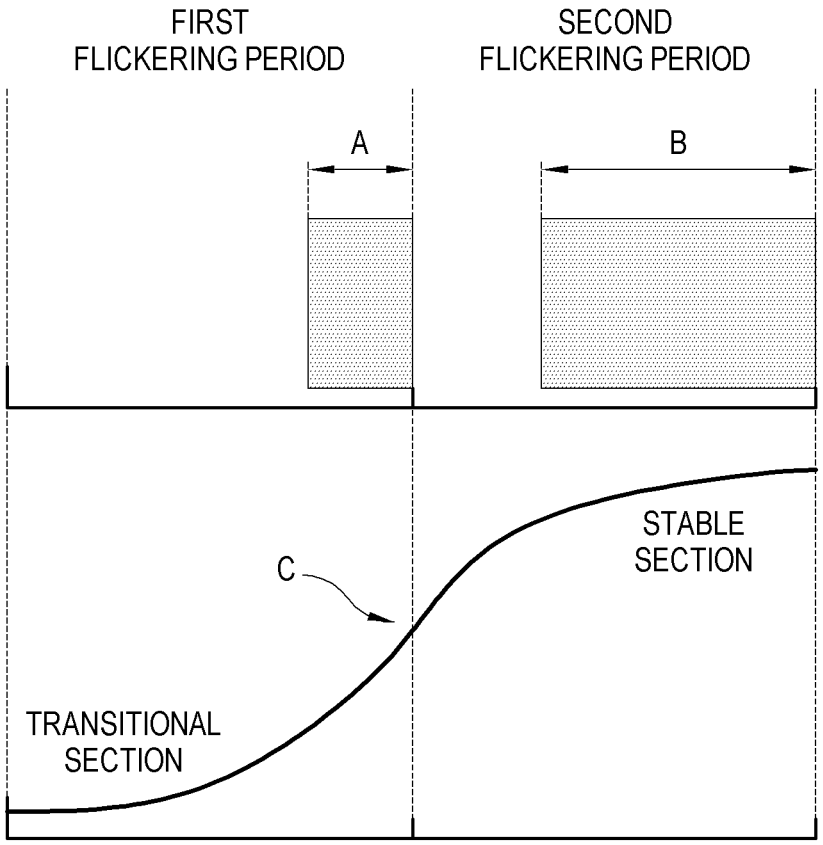
FIG. 7 illustrates comparison between states of liquid crystal and operations of a display apparatus that controls a flicker of a backlight unit according to an embodiment.

FIG. 7 illustrates comparison between states of liquid crystal and operations of a display apparatus that controls a flicker of a backlight unit according to an embodiment.

As shown in FIG. 7, two flickering periods, i.e., the first flickering period and the second flickering period, correspond to the displaying period for one video frame. The first flickering period and the second flickering period have the same width (i.e., time duration). According to an embodiment, the width A of the emissive section in the first flickering period is narrower than the width B of the emissive section in the second flickering period.

A curve C shows the state of the liquid crystal in the display panel. The liquid crystal moves toward a position corresponding to pixel information of the video frame in an early part of the displaying period for the video frame, and maintains the position corresponding to the pixel information of the video frame in a latter part of the displaying period for the video frame. For convenience, a section where the liquid crystal is moving toward the position corresponding to the pixel information of the video frame will be called a transitional section, and a section where the liquid crystal is stabilized maintaining the position corresponding to the pixel information of the video frame will be called a stable section.

In comparison between the state section of the liquid crystal and the flickering period of the light source, the transitional section of the liquid crystal corresponds to the first flickering period, and the stable section of the liquid crystal corresponds to the second flickering period. Here, a point in time for distinguishing between the transitional section and the stable section of the liquid crystal does not have to exactly match a point in time for distinguishing between the first flickering period and the second flickering period. For example, the point in time for distinguishing between the transitional section and the stable section may lag by a predetermined period of time behind the point in time for distinguishing between the first flickering period and the second flickering period. In either case, the transitional section of the liquid crystal precedes the stable section, and the first flickering period precedes the second flickering period.

During the first flickering period corresponding to the transitional section of the liquid crystal, the display apparatus decreases the width of the emissive section of the light source as much as possible to restrain an afterimage, and leaves the width of the emissive section as long as the flicker phenomenon does not occur. On the other hand, during the second flickering period corresponding to the stable section of the liquid crystal, the display apparatus increases the width of the emissive section of the light source as much as possible (e.g., to achieve a desired brightness), so that an image can be displayed through the stabilized liquid crystal and thus improved in definition. However, as described in the foregoing embodiment, a total length of A+B is determined based on the brightness of the video frame.

Below, a method of adjusting a flicker of a light source will be described.

Figure 8:
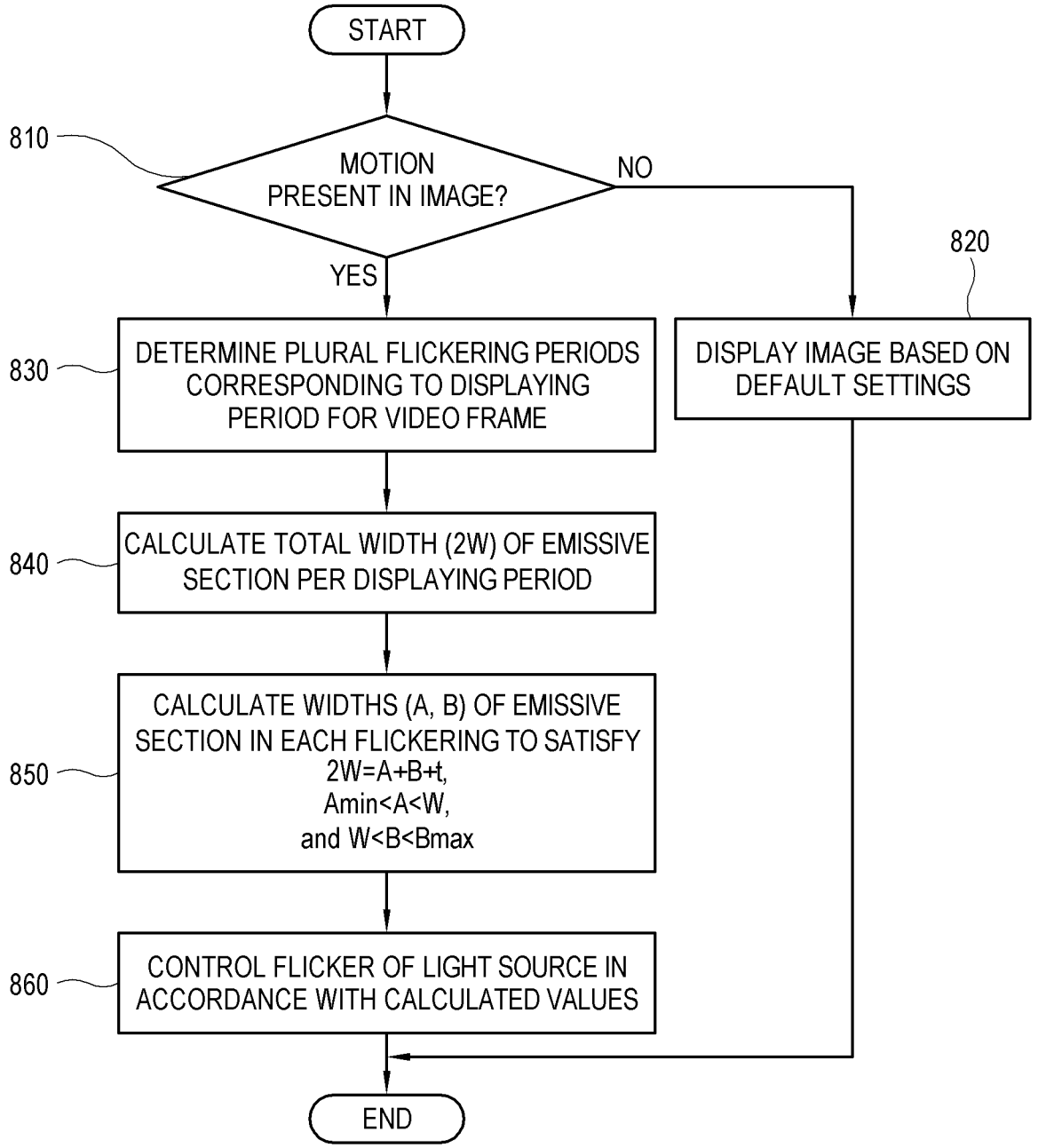
FIG. 8 is a flowchart of adjusting a flicker of a light source in a display apparatus according to an embodiment.

FIG. 8 is a flowchart of adjusting a flicker of a light source in a display apparatus according to an embodiment;

As shown in FIG. 8, the display apparatus controls operations of the light source as follows. The following operations of the display apparatus are implemented by at least one processor.

At operation 810, the display apparatus determines whether there is a change in an image, i.e., whether there is a motion in the image. Here, a reason for determining whether the motion is present in the image and a determining method will be described below.

When it is determined that no motions are present in the image, the display apparatus displays an image in accordance with default settings for the flicker of the light source at operation 820. The default settings refer to information about the flickering period of the light source, the width of the emissive section, etc., in a typical case that the display apparatus displays an image. The default settings may be given according to the attributes of the display apparatus or the attributes of the image signal. Alternatively, the default settings may be designed to have the operation control as shown in the case #3 of FIG. 6.

On the other hand, when it is determined that there is a motion in the image, the display apparatus determines a plurality of flickering periods of the light source relative to the displaying period of the video frame at operation 830.

At operation 840, the display apparatus calculates a total width (2 W) of the emissive section of the light source with respect to the displaying period of the video frame. Because the total width (2 W) indicates the brightness of the video frame, the total width (2 W) depends on (or varies according to) the scene of the video frame.

At operation 850, the display apparatus calculates the width (A) of the emissive section in the first flickering period and the width (B) of the emissive section in the second flickering period to satisfy conditions of $2W=A+B+t$, $Amin<A<W$, and $W<B<Bmax$, wherein Amin is the minimum value of A, Bmax is the maximum value of B, W is a half of the total width (2 W) of the emissive section of the light source per displaying period of the video frame, and t is a preset constant in which an error is taken into account. Here, Amin, Bmax, and t may be set based on experimental data obtained by a previous simulation, may be predetermined and provided to the display apparatus, and/or may be configured by a user. Amin may be the maximum value given as long as the flicker does not occur, and Bmax is smaller than 2 W.

At operation 860, the display apparatus controls the flicker of the light source in accordance with the calculated values.

According to the present embodiment, the display apparatus controls the light source to have a plurality of flickering periods per displaying period of the video frame, and relatively decreases the width (A) of the emissive section in the first flickering period, thereby preventing the motion blur phenomenon, the flicker phenomenon, and the afterimage phenomenon. Further, the display apparatus relatively increases the width (B) of the emissive section in the second flickering period, thereby improving the definition of the image.

Further, in the present embodiment, the display apparatus determines whether an image includes a motion, and adjusts the width of the emissive section when it is determined that the motion is present in the image. Below, the reason why such determination is performed will be described.

For example, when an image including a predetermined object is displayed on the display panel, the display apparatus takes into account whether the object is a still object or a moving object. Because the object is involved or included in the image, the image with the still object and the image with the moving object may also be called an image having no motions and an image having a motion, respectively.

Since there is little change in pixel values while the image has no motions, it is difficult to substantially distinguish between the transitional section and the stable section of the liquid crystal even though the video frame is changed. Therefore, in this case, the afterimage phenomenon does not occur even when the width of the emissive section in the first flickering period is equal to the width of the emissive section in the second flickering period.

On the other hand, there is much change in pixel values as time goes on while there is a motion in an image like a panning image, a scrolling image, or an image with a moving object. In this case, a user is highly likely to recognize the afterimage. Thus, when it is determined that the motion is present in the image, the display apparatus adjusts the width of the emissive section in the first flickering period to be narrower than the width of the emissive section in the second flickering period.

As a method of determining whether an image includes a motion, the display apparatus may determine whether there is change in pixel information according to video frames of the image for a predetermined period of time, thereby determining whether the motion is present in the image. In more detail, any of various methods may be used, such as a method based on an average picture level (APL) according to video frames, a method based on movement of an object determined in the video frame, a method based on metadata of an image signal, etc.

Below, the methods for determining whether the motion is present in the image will be schematically described.

Figure 9:
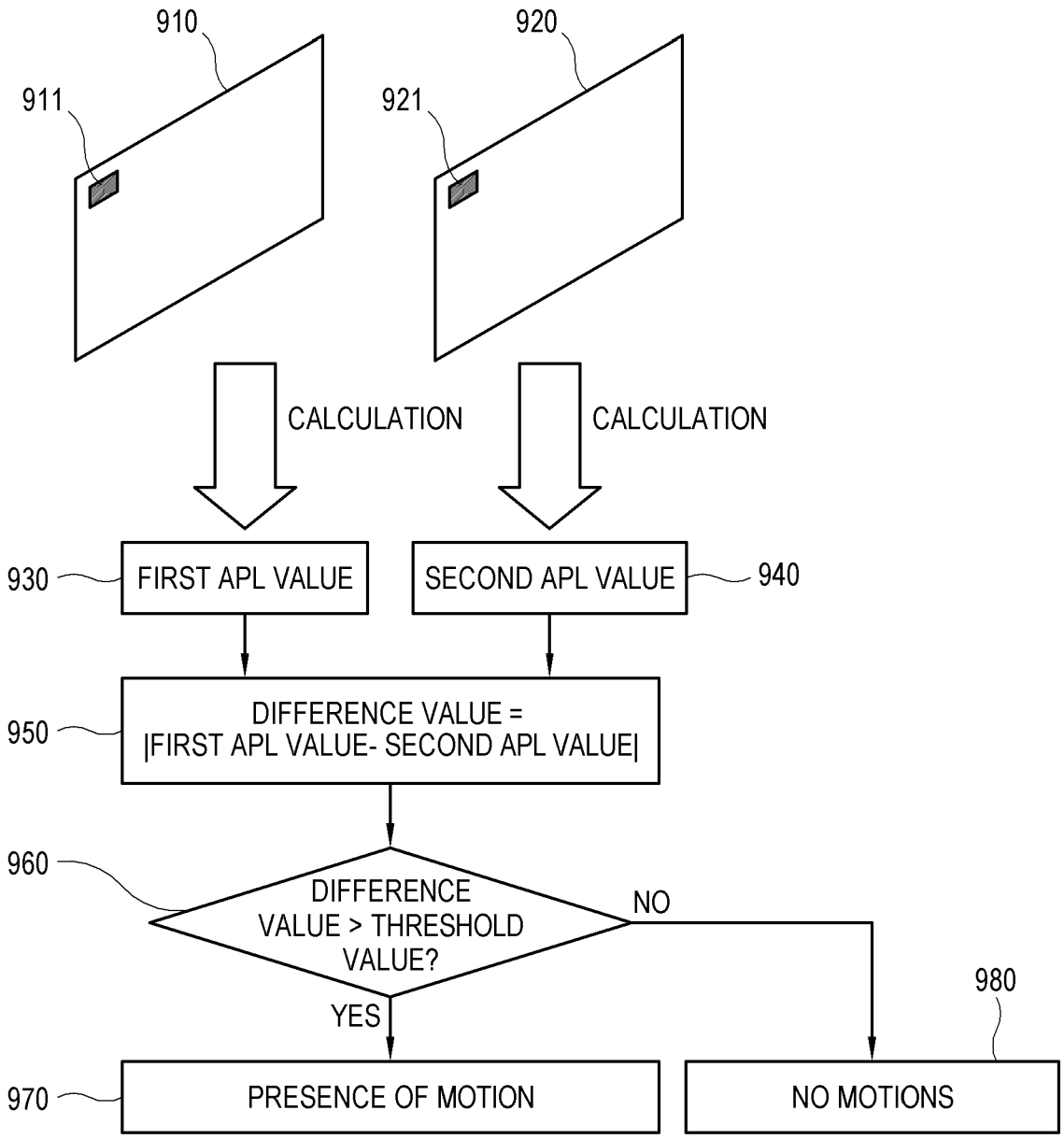
FIG. 9 illustrates a method of determining whether a motion is present in an image, based on an averaged picture level (APL) by a display apparatus according to an embodiment.

FIG. 9 illustrates a method of determining whether a motion is present in an image, based on the APL by a display apparatus according to an embodiment.

As shown in FIG. 9, the display apparatus determines whether the motion is present in the image, on the basis of the APL. The display apparatus considers a predetermined first video frame 910 and a second video frame 920, which are adjacent in time, as targets. The first video frame 910 includes a plurality of pixels 911, and the second video frame 920 includes a plurality of pixels 921. Although FIG. 9 illustrates only one pixel 911 or 921 in each of the video frames 910 and 920, it is understood that the video frames 910 and 920 actually include many pixels 911 and 921 according to resolutions.

The display apparatus calculates a first APL value 930 of the first video frame 910 by calculating gradation levels of a plurality of pixels 911 in the first video frame 910, and calculates a second APL value 940 of the second video frame 920 by calculating gradation levels of a plurality of pixels 921 in the second video frame 920. The APL calculation may, for example, be carried out by aggregating and averaging pixel values of all pixels in the video frame. It is understood, however, that one or more other embodiments are not limited thereto and various calculation methods may be applied to the APL calculation. The display apparatus derives the first APL value 930 from the gradation levels of all the pixels 911 in the first video frame 910, and likewise derives the second APL value 940 from the gradation levels of all the pixels 921 in the second video frame 920.

In operation 950, the display apparatus derives a difference value between the first APL value 930 and the second APL value 940 based on an absolute value obtained by subtracting the second APL value 940 from the first APL value 930 or subtracting the first APL value 930 from the second APL value 940.

The display apparatus compares this difference value with a preset threshold value in operation 960.

When it is determined that the difference value is greater than the threshold value, the display apparatus determines that a motion is present in the image in operation 970. On the other hand, when the difference value is not greater than the threshold value, the display apparatus determines that no motions are present in the image in operation 980.

In the present embodiment, the difference value between two video frames is used to determine the presence of the motion. Alternatively, the presence of the motion may be determined based on a plurality of difference values derived among three or more video frames.

Figure 10:
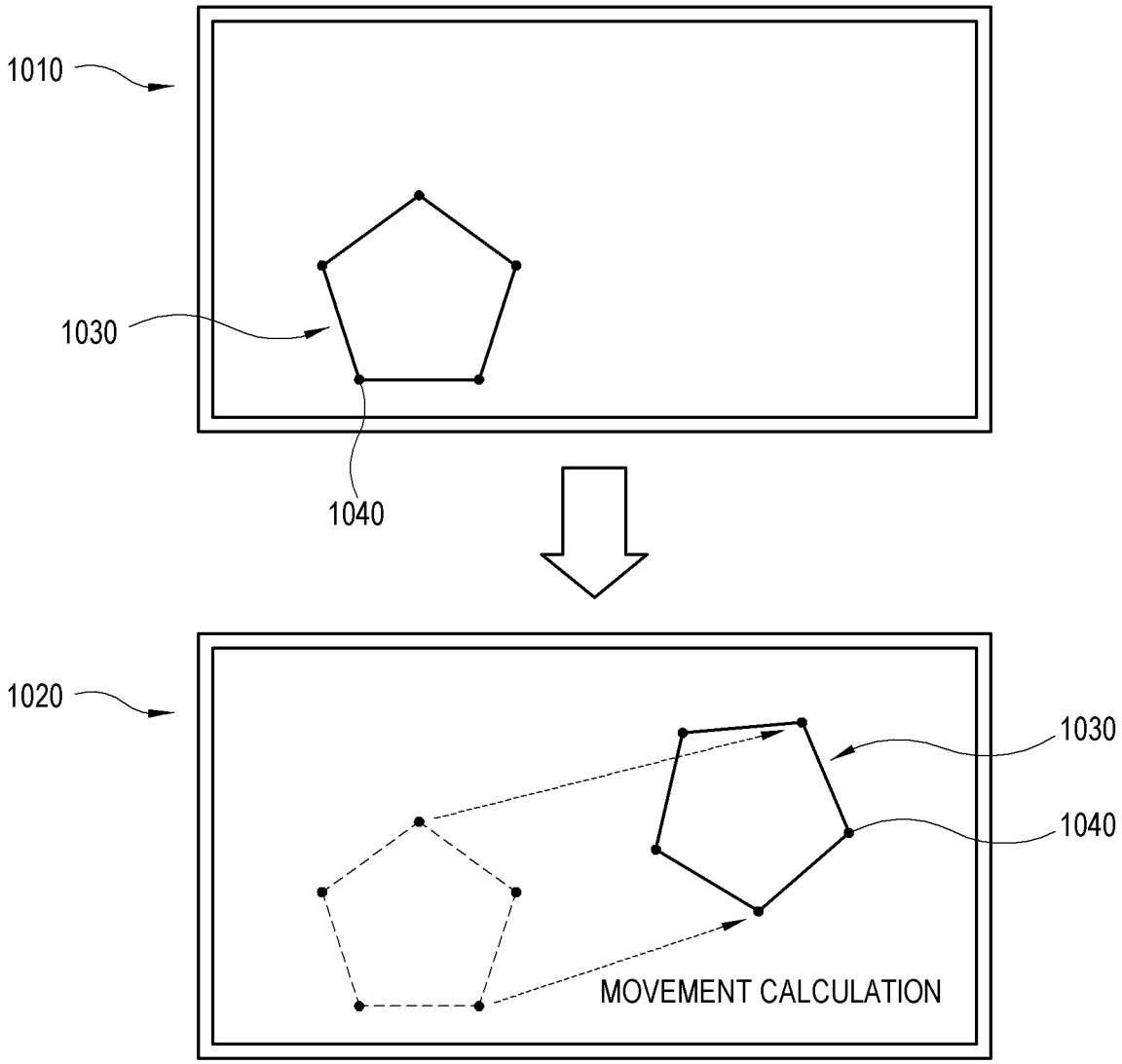
FIG. 10 illustrates a method of determining whether a motion is present in an image, based on an object identified in a video frame by a display apparatus according to an embodiment.

FIG. 10 illustrates a method of determining whether a motion is present in an image, based on an object identified in a video frame by a display apparatus according to an embodiment.

As shown in FIG. 10, the display apparatus identifies a predetermined object 1030 within a first video frame 1010. The display apparatus applies an edge detection principle to the object 1030 and determines the edges of the object 1030, thereby marking one or more identification points 1040 along the edges. In the edge detection principle, pixels having pixel values noticeably different from those of adjacent pixels in the video frame are connected to each other to thereby determine edges of an object.

In the same manner, the display apparatus identifies the object 1030 and marks one or more identification points 1040 within a second video frame 1020 subsequent to the first video frame 1010. The display apparatus makes comparison in relative positions between the identification point 1040 of the first video frame 1010 and the identification point 1040 of the second video frame 1020, and determines whether movement between the identification point 1040 of the first video frame 1010 and the identification point 1040 of the second video frame 1020 is greater than a predetermined threshold value.

When the movement is greater than the predetermined threshold value, the display apparatus determines that a motion is present in the image. When the movement is not greater than the predetermined threshold value, the display apparatus determines that no motions are present in the image.

It is understood that, besides the foregoing methods, the display apparatus may employ various methods to determine whether an image involves a motion.

Meanwhile, the display apparatus may determine a degree of motion in terms of determining whether the motion is present in the image. In other words, the display apparatus may determine whether a motion in the image is relatively big or relatively small. With this determination, the display apparatus may control a flicker operation of a light source in accordance with a motion degree in the image. An embodiment of such a motion degree determination will be described below.

Figure 11:
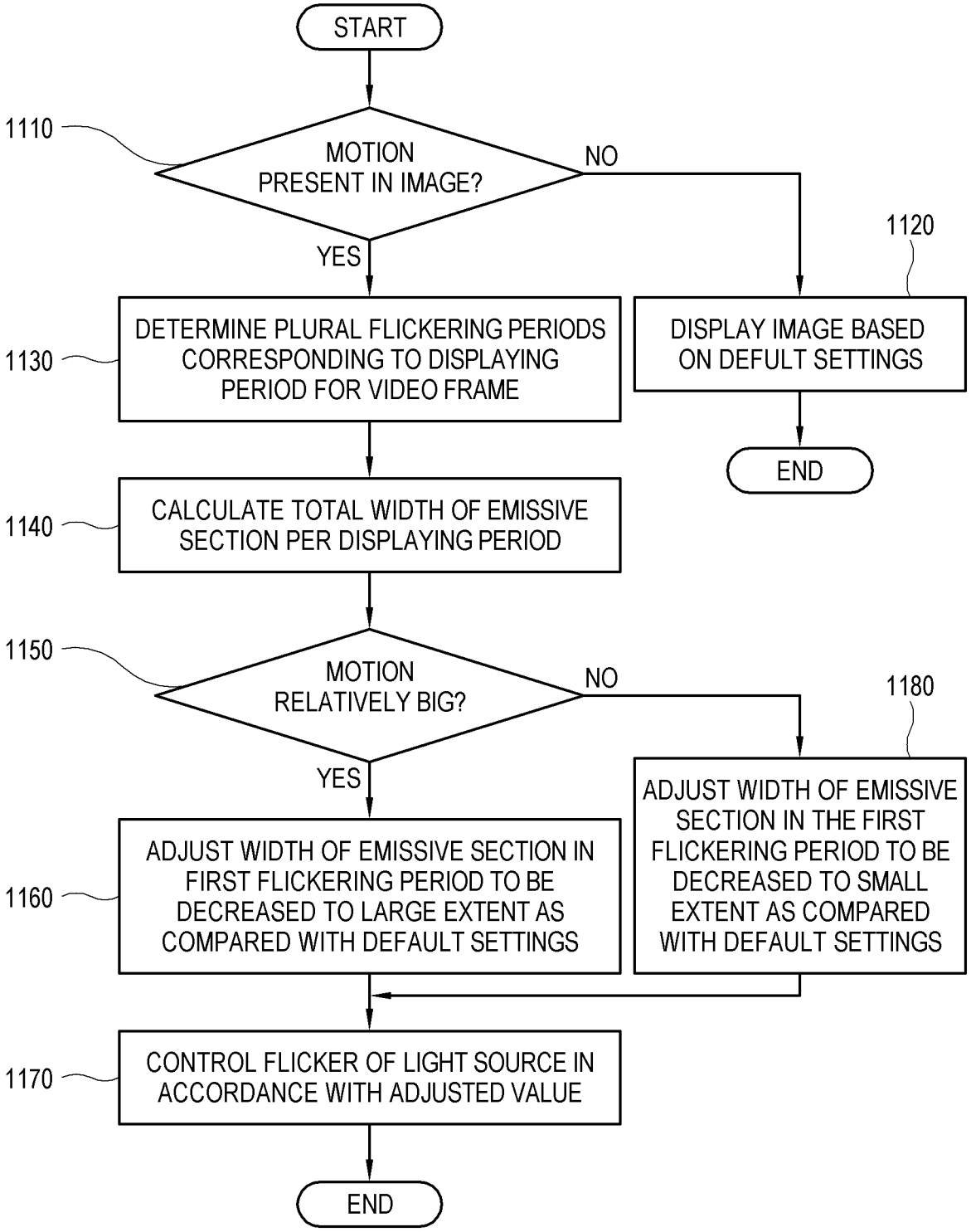
FIG. 11 is a flowchart showing a method of controlling a flickering operation of a light source in accordance with a motion degree within an image by a display apparatus according to an embodiment.

FIG. 11 is a flowchart showing a method of controlling a flickering operation of a light source in accordance with a motion degree within an image by a display apparatus according to an embodiment.

Referring to FIG. 11, the display apparatus determines whether a motion is present in an image at operation 1110.

When there are no motions in the image, the display apparatus displays the image in accordance with default settings at operation 1120. The default settings refer to information about a flickering period of a light source, a width of an emissive section, etc., so that the display apparatus can typically display an image.

On the other hand, where there is a motion in the image, a plurality of flickering periods of the light source is determined corresponding to the displaying period of the video frame at operation 1130.

At operation 1140, the display apparatus calculates the whole width of the emissive section in the flickering period per displaying period of the light source. These operations are the same as or similar to described in the foregoing embodiments.

At operation 1150, the display apparatus determines whether the determined motion is relatively big. For example, under the condition that it is determined that the motion is present in the image in operation 1110, the display apparatus may determine that the motion in the image is relatively big when a quantified motion value is greater than a predetermined threshold value, and determine that the motion in the image is relatively small when the motion value is not greater than the threshold value.

When it is determined that the motion in the image is relatively big, at operation 1160, the display apparatus adjusts the width of the emissive section in the first flickering period to be decreased to a large extent (i.e., first extent) as compared with that of the default settings.

At operation 1170, the display apparatus controls the flicker of the light source in accordance with the adjusted value.

On the other hand, when it is determined that the motion in the image is not relatively big, at operation 1180, the display apparatus adjusts the width of the emissive section in the first flickering period to be decreased to a small extent (i.e., second extent, less than the first extent) as compared with that of the default settings, and enters the operation 1170.

Here, the width of the emissive section in the first flickering period adjusted in the operation 1160 is narrower than the width of the emissive section in the first flickering period adjusted in the operation 1180. Below, a reason why the control in this embodiment is provided will be described in more detail.

Figure 12:
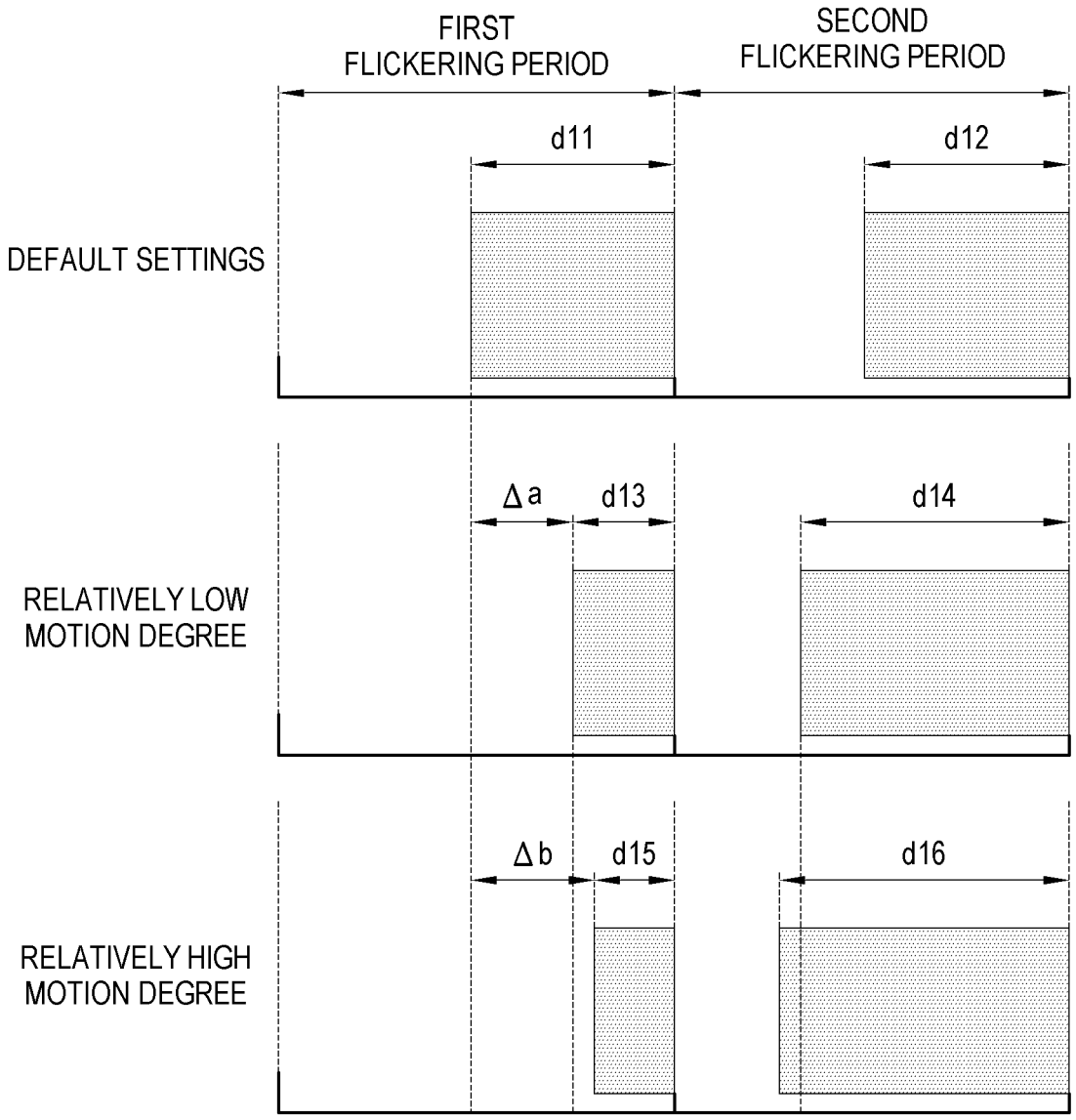
FIG. 12 is a duty-ratio graph showing a principle of adjusting a width of an emissive section as compared to default settings in accordance with a motion in an image by a display apparatus according to an embodiment.

FIG. 12 is a duty-ratio graph showing a principle of adjusting a width of an emissive section as compared to default settings in accordance with a motion in an image by a display apparatus according to an embodiment;

As shown in FIG. 12, the display apparatus controls the flicker of the light source differently according to the default settings, a case where a motion degree in an image is relatively low, and a case where the motion degree is relatively how. In the present embodiment, the light source flickers by the first flickering period and the second flickering period corresponding to the displaying period for one video frame. The first flickering period precedes the second flickering period.

The default settings are applied when it is determined that no motions are present in the image. In the default settings according to the present embodiment, a width d11 of the emissive section in the first flickering period is equal to a width d12 of the emissive section in the second flickering period. However, the default settings are not limited to this example. Alternatively, d11<d12 may be designated in the default settings.

When it is determined that there is a motion in the image, the display apparatus basically adjusts the width of the emissive section in the first flickering period to be narrower than the width of the emissive section in the second flickering period, thereby coping with the flicker phenomenon and the afterimage phenomenon. In accordance with whether a degree of such a motion is relatively high or low, the display apparatus determines how much (i.e., an extent) the width of the emissive section in the first flickering period will be decreased as compared to the default settings.

When the motion degree in the image is relatively low, a user is less likely to recognize an afterimage in the image. In this case, the display apparatus calculates a width d13 of the emissive section in the first flickering period as [d13=d11−Δa]. Here, Δa is a preset positive value. Further, the display apparatus calculates a width d14 of the emissive section in the second flickering period as [d14=d12+Δa]. Because [d11+d12=d13+d14] is satisfied as long as voltage is equally applied to the light source, a total brightness of video frames is not changed in any case.

On the other hand, when the motion degree in the image is relatively high, a user is highly likely to recognize an afterimage in the image. Therefore, the display apparatus operates by placing more emphasis on restraint of the afterimage phenomenon. In this case, the display apparatus calculates a width d15 of the emissive section in the first flickering period as [d15=d11−Δb]. Here, Δb is a preset positive value, and satisfies Δb>Δa. Further, the display apparatus calculates a width d16 of the emissive section in the second flickering period as [d16=d12+Δb]. When a voltage is equally applied to the light source, [d11+d12=d15+d16] is satisfied.

In brief, the display apparatus adjusts the width of the emissive section in the first flickering period as follows. When the motion degree in the image is relatively low, the display apparatus adjusts the width d13 of the emissive section in the first flickering period to be decreased by Δa as compared with the width d11 in the default settings. On the other hand, when the motion degree in the image is relatively high, the display apparatus adjusts the width d15 of the emissive section in the first flickering period to be decreased by Δb greater than Δa as compared with the width d11 in the default settings. Thus, the display apparatus copes with the afterimage phenomenon that occurs when the motion degree is high.

Meanwhile, the display apparatus determines how much the width of the emissive section in the first flickering period will be adjusted, based on preset settings. Such settings may be stored in the display apparatus on the basis of data from previously implemented experiments when the display apparatus is manufactured. Alternatively, the display apparatus may provide a user interface (UI) to receive corresponding settings from a user. In this regard, an embodiment will be described.

Figure 13:
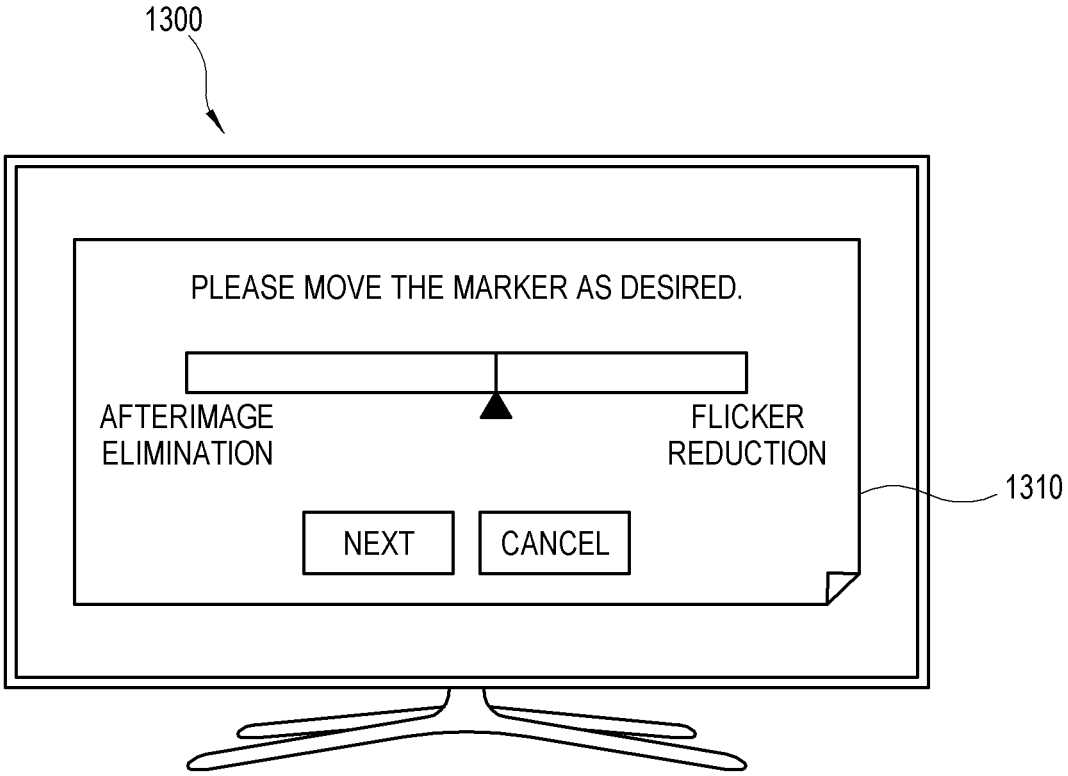
FIG. 13 illustrates a user interface (UI) displayable by a display apparatus according to an embodiment.

FIG. 13 illustrates a UI 1310 displayable by a display apparatus 1300 according to an embodiment.

As shown in FIG. 13, a display apparatus 1300 may display a UI 1310 in response to a user's input, so that the user can change a width of an emissive section in a first flickering period. Here, the first flickering period is equivalent to those of the foregoing embodiments, and indicates a flickering period corresponding to a transitional section of a liquid crystal among a plurality of flickering periods of the light source corresponding to the displaying period for one video frame.

The UI 1310 may for example include a bar object extended in left and right directions, and a gauge adjustment object including a marker object movable along the bar object. As a user moves the marker left or right along the bar on the UI 1310, the width of the emissive section corresponding to the transitional section of the liquid crystal is adjusted.

The display apparatus 1300 decreases the width of the emissive section corresponding to the transitional section of the liquid crystal as the marker moves toward the left of the bar object, but increases the width of the emissive section corresponding to the transitional section of the liquid crystal as the marker moves toward the right of the bar object. As the marker moves toward the left of the bar object, it is effective to eliminate an afterimage. As the marker moves toward the right of the bar object, it is effective to reduce a flicker. The UI 1310 allows a user to easily know effects of the user's input rather than details of technical content.

The afterimage elimination effect and the flicker reduction effect may be achieved by conflicting configurations. To eliminate the afterimage, the amount of light emitted from the light source may be decreased during the transitional section of the liquid crystal and increased during the stable section of the liquid crystal. On the other hand, to reduce the flicker, the width of the section where the light source does not emit light may be decreased.

The display apparatus 1300 minimizes the width of the emissive section corresponding to the transitional section of the liquid crystal when the marker is located at the leftmost position of the bar object, and maximizes the width of the emissive section corresponding to the transitional section of the liquid crystal when the marker is located at the rightmost position of the bar object. In this manner, the display apparatus 1300 improves either of the afterimage elimination effect or the flicker reduction effect while restraining both the afterimage and the flicker.

Meanwhile, the width of the emissive section corresponding to the transitional section of the liquid crystal may be set in the display apparatus 1300 when the display apparatus 1300 is manufactured. However, all kinds or all models of the display apparatus 1300 may not have a common value designated for the width. Below, a method of determining the designated value according to the display apparatuses 1300 will be described.

Figure 14:
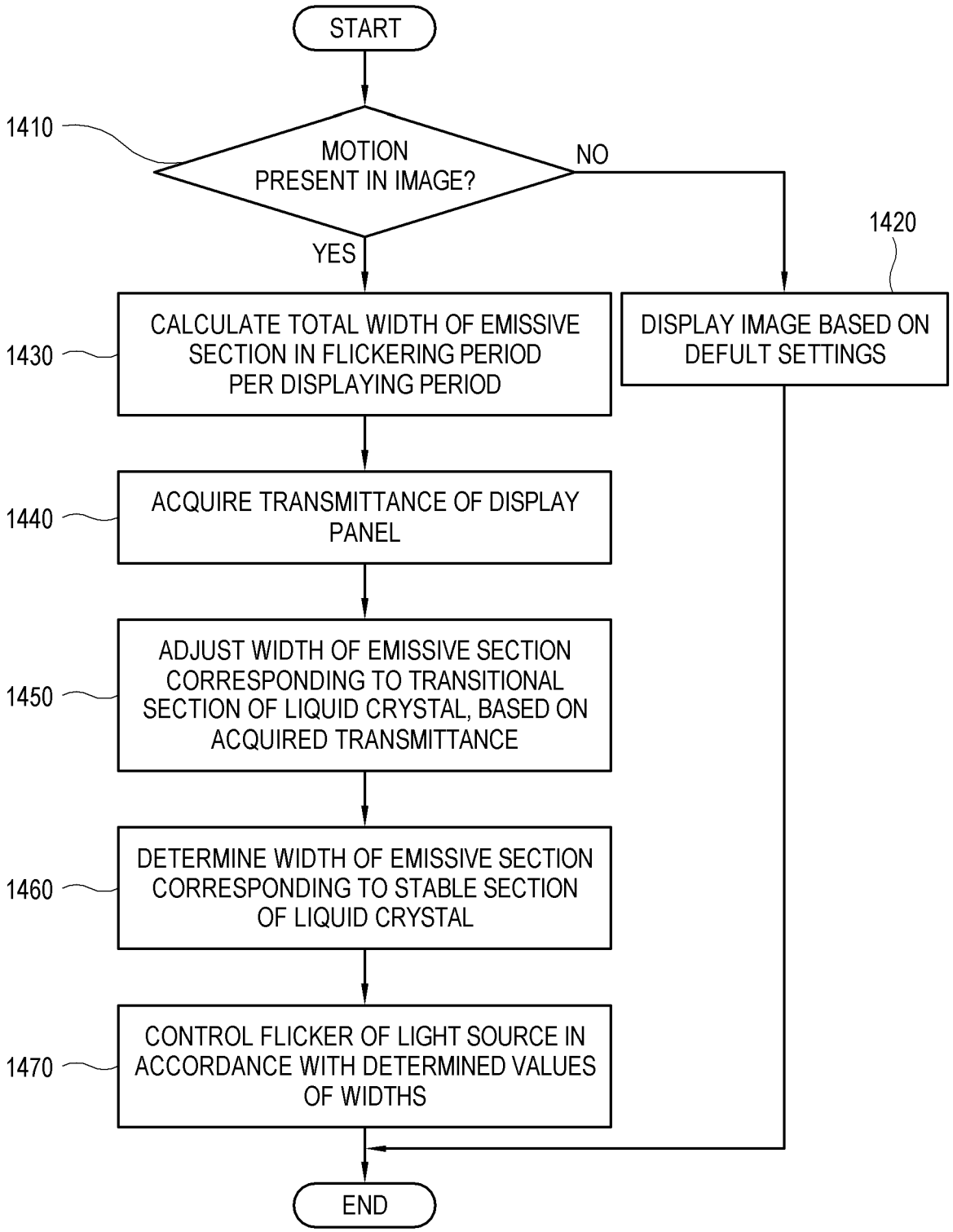
FIG. 14 is a flowchart showing a method of determining a width of an emissive section in accordance with attributes of a display apparatus by the display apparatus according to an embodiment.

FIG. 14 is a flowchart showing a method of determining a width of an emissive section in accordance with attributes of a display apparatus by the display apparatus according to an embodiment.

Referring to FIG. 14, the display apparatus determines whether there is a motion in an image at operation 1410.

When it is determined that no motions are present in the image, the display apparatus displays an image in accordance with default settings at operation 1420.

On the other hand, when it is determined that a motion is present in the image, the display apparatus calculates a total width of an emissive section in each flickering period with regard to a plurality of flickering periods corresponding to a displaying period for a video frame, at operation 1430.

At operation 1440, the display apparatus acquires transmittance of a display panel. The display apparatus may acquire information about the transmittance of the display panel from its own read only memory (ROM) or the like, or acquire information from a server provided by a manufacturer of the display apparatus through a network.

At operation 1450, the display apparatus adjusts the width of the emissive section corresponding to the transitional section of the liquid crystal on the basis of the acquired transmittance. For example, even less emission of light is enough to restrain the flicker phenomenon when the transmittance of the display panel is relatively high, and therefore the display apparatus may place emphasis on the restraint of the afterimage by additionally decreasing the width close to the minimum value. On the other hand, more emission of light is needed to restrain the flicker phenomenon when the transmittance of the display panel is relatively low, and therefore the display apparatus copes with the flicker phenomenon by additionally increasing the width close to the maximum value.

At operation 1460, the display apparatus determines the width of the emissive section corresponding to the stable section of the liquid crystal on the basis of the adjusted width of the emissive section corresponding to the transitional section of the liquid crystal. That is, the display apparatus controls the sum of the width of the emissive section corresponding to the transitional section of the liquid crystal and the width of the emissive section corresponding to the stable section of the liquid crystal be equal to the previously calculated total width of the emissive section.

At operation 1470, the display apparatus controls the flicker of the light source in accordance with the determined values of the widths.

Thus, the display apparatus adjusts the width of the emissive section corresponding to the transitional section of the liquid crystal in accordance with the attributes of the display apparatus. In the present embodiment, the transmittance of the display panel is described as the attributes of the display apparatus. It is understood, however, that one or more other embodiments are not limited thereto. Alternatively, other parameters may be used as the attributes of the display apparatus.

Meanwhile, the foregoing embodiments describe that the total width of the emission section in the flickering period is calculated per displaying period for one video frame. The total width may be derived by various methods. Below, a method of deriving the total width of the emissive section by the display apparatus will be described.

Figure 15:
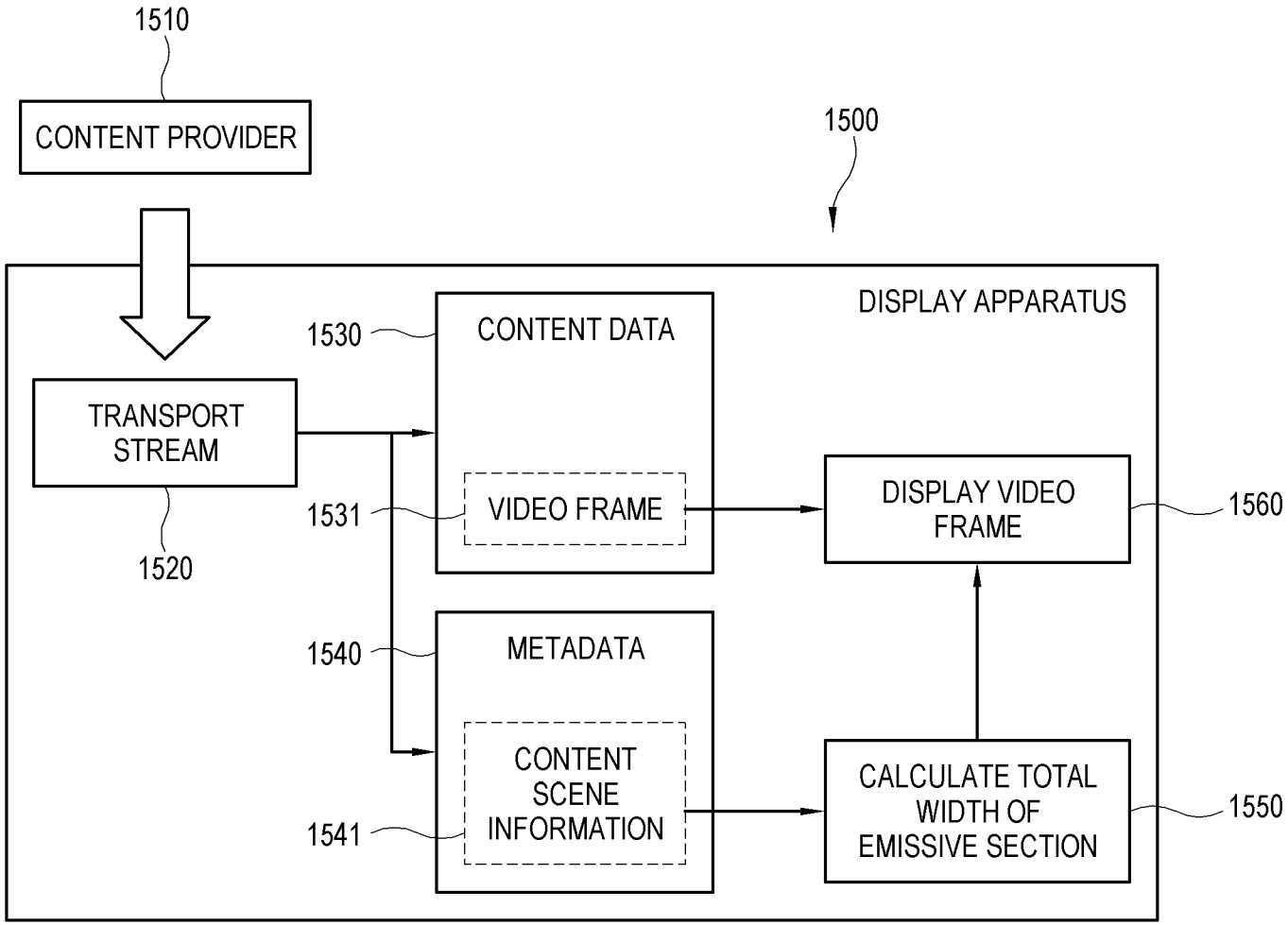
FIG. 15 is a block diagram showing a principle of receiving and processing a transport stream in a display apparatus according to an embodiment.

FIG. 15 is a block diagram showing a principle of receiving and processing a transport stream 1520 in a display apparatus 1500 according to an embodiment.

As shown in FIG. 15, a display apparatus 1500 receives a transport stream 1520 including a content signal from a content provider 1510. The display apparatus 1500 extracts content data 1530 and metadata 1540 from the transport stream 1520. The content data 1530 includes video data and audio data for reproducing content, and the video data includes data of a plurality of video frames 1531 arranged in time sequence.

The metadata 1540 may include various pieces of information to be referenced to display the content data 1530 as an image. These pieces of information are arranged in fields within the metadata 150 according to predetermined standards. The metadata 1540 may include content scene information 1541 indicating a brightness level of a scene of a certain video frame 1531. For example, the content scene information 1541 may include an average of gradation levels that the pixels included in the video frame 1531 have.

In operation 1550, the display apparatus 1500 may calculate the total width of the emissive section in the displaying period for the video frame 1531 on the basis of the content scene information 1541. For example, the display apparatus 1500 sets the total width of the emissive sections to be longer as the average of the gradation levels becomes higher, and sets the total width of the emissive sections to be shorter as the average of the gradation levels becomes lower. Further, in operation 1560, the display apparatus 1500 calculates the width of each emissive section based on the set total width of the emissive sections, and controls the flicker of the light source while the video frame is displayed in accordance with results of the calculation.

According to another embodiment, the content scene information 1541 may include an identification value corresponding to a brightness level of a scene containing just the video frame 1531. For example, when the brightness of the scene is divided into five levels from a dark level of "0" to bright level of "5," the content scene information 1541 includes information that the video frame 1531 has one among the levels of "0" to "5." The display apparatus 1500 may determine the total width of the emissive sections, based on this information.

In the foregoing embodiments, the display apparatus operates to turn on the light source by adjusting a turning-on time rather than keeping a voltage constant. Alternatively, both the voltage and the time may be adjusted in turning on the light source. In this regard, an embodiment will be described below.

Figure 16:
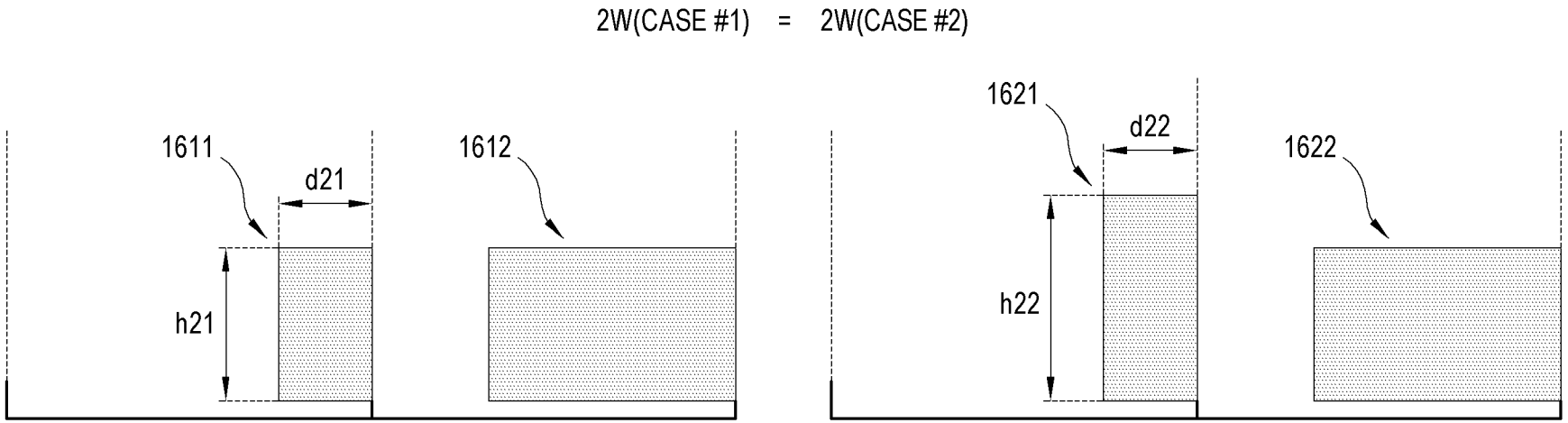
FIG. 16 is a duty-ratio graph showing a principle of controlling a flicker operation of a light source in a display apparatus according to an embodiment.

FIG. 16 is a duty-ratio graph showing a principle of controlling a flicker operation of a light source in a display apparatus according to an embodiment.

As shown in FIG. 16, the display apparatus may control the light source to operate in accordance with the left case #1 or the right case #2. Regarding the total width of the emissive sections corresponding to the displaying period for one video frame, 2 W (case #1) is equal to 2 W (case #2).

The case #1 is the same as or similar to those described in the foregoing embodiments. That is, the display apparatus controls a width of an emissive section 1611 in a first flickering period to be shorter than a width of an emissive section 1612 in a second flickering period, thereby restraining an afterimage phenomenon. In this case, the display apparatus adjusts the turning-on time in the emissive section 1611 in the first flickering period and the emissive section 1612 in the second flickering period, and does not adjust the applied voltage.

On the other hand, in the case #2, the display apparatus adjusts not only the turning-on time of the light source, but also the applied voltage. For convenience, the display apparatus equally controls the emissive section 1612 in the second flickering period of the case #1 and the emissive section 1622 in the second flickering period of the case #2, and adjusts the emissive section 1621 in the first flickering period of the case #2.

The display apparatus adjusts the turning-on time of the emissive section 1621 in the first flickering period to be shorter than that of the case #1, instead of controlling the applied voltage of the emissive section 1621 in the first flickering period be higher than that of the case #1. In the duty-ratio graph, d21>d22 and h21<h22. Here, d21 and h21 are respectively the width and height of the emissive section 1611 in the first flickering period of the case #1, and d22 and h22 are respectively the width and height of the emissive section 1621 in the first flickering period of the case #2.

When the display apparatus controls the emissive section 1621 as in the case #2, it is possible to cause the turning-on time of the light source in the transitional section of the liquid crystal to be shorter than that in the case #1. Therefore, the case #2 more efficiently restrains the afterimage phenomenon than the case #1.

The case #3 describes change in the emissive section of the second flickering period. In the case #3, an emissive section 1632 in the second flickering period is adjusted while controlling an emissive section 1631 in the first flickering period to be equal to the emissive section 1611 in the first flickering period in the case #1.

When the display apparatus controls the width d23 of the emissive section in the first flickering period to be narrower than the width of the emissive section in the second flickering period, the voltage (and not the width of the emissive section) is adjusted to maintain the total brightness. In the duty-ratio graph, d21=d22 and h21<h23. Here, d21 and h21 are respectively the width and height of the emissive section 1611 in the first flickering period of the case #1, and d23 and h23 are respectively the width and height of the emissive section 1632 in the first flickering period of the case #3.

With this control, it is possible to solve a problem of impossible compensation in the second flickering period while a duty width is fully used in a bright image.

Meanwhile, the foregoing embodiments describe that the displaying period for one video frame is divided into two flicking periods. It is understood, however, that one or more other embodiments are not limited thereto. For example, the display apparatus may be embodied to set three or more flickering periods corresponding to the displaying period for one video frame. Such an embodiment will be described below.

Figure 17:
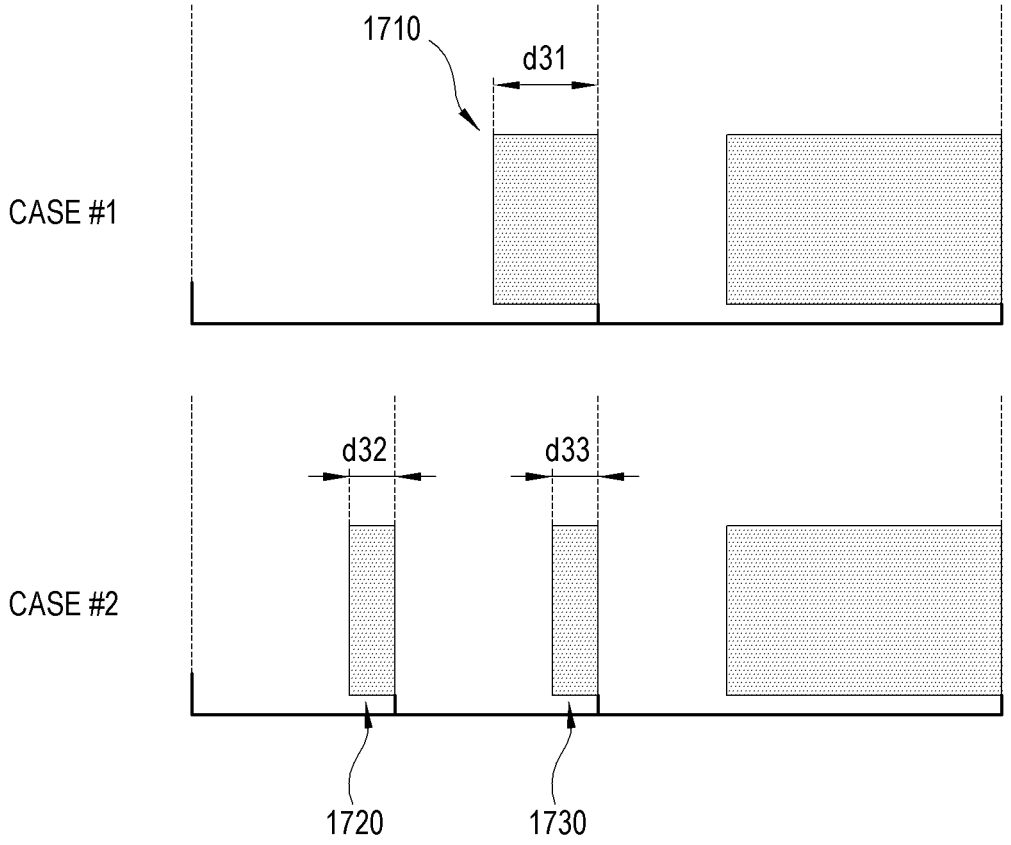
FIG. 17 is a duty-ratio graph showing a principle of controlling a flicker operation of a light source in a display apparatus according to an embodiment.

FIG. 17 is a duty-ratio graph showing a principle of controlling a flicker operation of a light source in a display apparatus according to an embodiment.

As shown in FIG. 17, the display apparatus may control the light source to operate in accordance with the upper case #1 or the lower case #2. The case #1 is the same as or similar to those described in the foregoing embodiments. That is, the display apparatus sets a flickering period corresponding to the transitional section of the liquid crystal, and two flickering periods including the flickering period of the stable section of the liquid crystal, within the displaying period for one video frame. The display apparatus controls a width of an emissive section 1710 in the flickering period corresponding to the transitional section to be narrower than the width of the emissive section in the flickering period corresponding to the stable section, thereby straining an afterimage phenomenon.

On the other hand, the case #2 shows that two flickering periods corresponding to the transitional section of the liquid crystal are set within the displaying period for one video frame. That is, the case #2 sets first and second flickering periods corresponding to the transitional section of the liquid crystal, and a third flickering period corresponding to the stable section of the liquid crystal.

For convenience, it will be assumed that the case #1 and the case #2 have the same total width of the emissive sections corresponding to the displaying period for one video frame. When a width of an emissive section 1710 in a flickering period corresponding to the transitional section of the liquid crystal in the case #1 is d31, and widths of emissive sections 1720 and 1730 in two flickering periods corresponding to the transitional section of the liquid crystal in the case #2 are respectively d32 and d33, the widths may be set to satisfy d31>d32+d33. A reason why the widths are not set to satisfy d31=d32+d33 is as follows.

When the frequency of the flicker operation for the light source becomes three or more times greater than a displaying frequency for a video frame, the number of times of turning on the light source within a predetermined period of time is relatively increased. Both the afterimage and flicker phenomena are perceptual phenomena for a user, and a phenomenon that an image remains in a user's vision noticeably occurs as the frequency of the flicker operation for the light source becomes higher. For example, while a user is viewing an image of an emissive section 1730, an image of a previous emissive section 1720 remains in the vision, and therefore the brightness of the image a user feels actually may be higher than the brightness corresponding to the emissive section 1730. Therefore, the display apparatus is set to satisfy not d31=d32+d33, but d31>d32+d33, thereby straining the flicker phenomenon and the afterimage phenomenon while controlling the overall brightness a user feels.

The methods according to the foregoing embodiments may be achieved in the form of a program command that can be implemented in various computers, and recorded in a computer readable medium. Such a computer readable medium may include a program command, a data file, a data structure or the like, or combination thereof. For example, the computer readable medium may be stored in a volatile or nonvolatile storage such as a ROM or the like, regardless of whether it is deletable or rewritable, for example, a RAM, a memory chip, a device or integrated circuit (IC) like memory, or an optically or magnetically recordable or machine (e.g., a computer)-readable storage medium, for example, a compact disk (CD), a digital versatile disk (DVD), a magnetic disk, a magnetic tape or the like. It will be appreciated that a memory, which can be included in a mobile terminal, is an example of the machine-readable storage medium suitable for storing a program having instructions for realizing the embodiments. The program command recorded in this storage medium may be specially designed and configured according to the embodiments, or may be publicly known and available to those skilled in the art of computer software.

Although a few embodiments have been shown and described, it will be appreciated by those skilled in the art that changes may be made in these embodiments without departing from the principles and spirit of the present inventive concept(s), the scope of which is defined in the appended claims and their equivalents.

What is claimed is:

1. A display apparatus comprising:

a display panel comprising a liquid crystal display;

a driver configured to drive the display panel based on an image signal;

a light source configured to supply light for making an image visible on the display panel; and a processor configured to:

control the light source to have two or more emissive sections during a displaying period for one video frame of the image signal, wherein the two or more emissive sections are separated by at least one non-emissive section, and adjust a first emissive section and a second emissive section, of the two or more emissive sections, to have different widths in accordance with a change of the liquid crystal display within the displaying period for one video frame, wherein a width of the second emissive section corresponding to a stable section of the liquid crystal display is greater than a width of the first emissive section corresponding to a transitional section of the liquid crystal display.

2. The display apparatus according to claim 1, wherein the first emissive section precedes the second emissive section in time.

3. The display apparatus according to claim 1, wherein:

the first emissive section corresponds to a period of a transitional section of a liquid crystal in the liquid crystal display, and the second emissive section corresponds to a period of a stable section of the liquid crystal.

4. The display apparatus according to claim 1, wherein the processor is configured to adjust a difference between the width of the first emissive section and the width of the second emissive section without changing a sum of the width of the first emissive section and the width of the second emissive section.

5. The display apparatus according to claim 1, wherein the processor is configured to identify whether there is the change of the liquid crystal display, based on a degree of change in average picture level (APL) according to video frames.

6. The display apparatus according to claim 1, wherein the processor is configured to:

identify an amount of motion in the image when there is the change of the liquid crystal display;

adjust the width of the first emissive section to have a first width when the amount of motion is greater than a threshold value; and adjust the width of the first emissive section to have a second width, greater than the first width, when the amount of motion is less than the threshold value.

7. The display apparatus according to claim 1, wherein the processor is configured to:

control the display panel to display a menu for allowing a user to adjust the width of the first emissive section; and adjust the first emissive section based on the width adjusted through the menu.

8. The display apparatus according to claim 1, wherein the processor is configured to adjust the width of the first emissive section to have a first width based on the display panel having a first transmittance, and to have a second width, greater than the first width, based on the display panel having a second transmittance lower than the first transmittance.

9. The display apparatus according to claim 1, wherein the processor is configured to acquire information about brightness of the image from metadata of the image signal, and to identify a total width of the two or more emissive sections based on the acquired information.

10. The display apparatus according to claim 1, wherein the processor is configured to adjust a voltage applied during the first emissive section or the second emissive section, and to adjust the width of the first emissive section or the width of the second emissive section in accordance with the adjusted voltage.

11. A method of controlling a display apparatus, the method comprising:

driving a display panel comprising a liquid crystal display, based on an image signal;

controlling a light source, which is provided to supply light to the display panel, to have two or more emissive sections during a displaying period for one video frame of the image signal, wherein the two or more emissive sections are separated by at least one non-emissive section; and adjusting a first emissive section and a second emissive section, of the two or more emissive sections, to have different widths in accordance with a change of the liquid crystal display within the displaying period for one video frame, wherein a width of the second emissive section corresponding to a stable section of the liquid crystal display is greater than a width of the first emissive section corresponding to a transitional section of the liquid crystal display.

12. The method according to claim 11, wherein the first emissive section precedes the second emissive section in time.

13. The method according to claim 11, wherein:

the first emissive section corresponds to a period of a transitional section of a liquid crystal in the liquid crystal display, and the second emissive section corresponds to a period of a stable section of the liquid crystal.

14. The method according to claim 11, wherein the adjusting the first emissive section and the second emissive section comprises adjusting a difference between the width of the first emissive section and the width of the second emissive section without changing a sum of the width of the first emissive section and the width of the second emissive section.

15. The method according to claim 11, further comprising identifying whether there is the change of the liquid crystal display, based on a degree of change in average picture level (APL) according to video frames.

16. The method according to claim 11, wherein the adjusting the first emissive section and the second emissive section comprises:

identifying an amount of motion in an image when there is the change of the liquid crystal display;

adjusting the width of the first emissive section to have a first width when the amount of motion is greater than a threshold value; and adjusting the width of the first emissive section to have a second width, greater than the first width, when the amount of motion is less than the threshold value.

17. The method according to claim 11, wherein the adjusting the first emissive section and the second emissive section comprises:

adjusting the width of the first emissive section to have a first width based on the display panel having a first transmittance, and to have a second width, greater than the first width, based on the display panel having a second transmittance lower than the first transmittance.

18. The method according to claim 11, wherein the adjusting the first emissive section and the second emissive section comprises acquiring information about brightness of an image from metadata of the image signal, and identifying a total width of the two or more emissive sections based on the acquired information.

19. The method according to claim 11, wherein the adjusting the first emissive section and the second emissive section comprises adjusting a voltage applied during the first emissive section or the second emissive section, and adjusting the width of the first emissive section or the width of the second emissive section in accordance with the adjusted voltage.

20. A nonvolatile computer-readable recording medium, in which a program code of a method implementable by a processor of a display apparatus is stored, the method comprising:

driving a display panel comprising a liquid crystal display, based on an image signal;

controlling a light source, which is provided to supply light to the display panel, to have two or more emissive sections during a displaying period for one video frame of the image signal, wherein the two or more emissive sections are separated by at least one non-emissive section; and adjusting a first emissive section and a second emissive section, of the two or more emissive sections, to have different widths in accordance with a change of the liquid crystal display within the displaying period for one video frame, wherein a width of the second emissive section corresponding to a stable section of the liquid crystal display is greater than a width of the first emissive section corresponding to a transitional section of the liquid crystal display.

* * * * *